US012529478B2

(12) United States Patent
Bruin-Slot et al.

(10) Patent No.: US 12,529,478 B2
(45) Date of Patent: Jan. 20, 2026

(54) SELECTIVELY DETACHABLE HANDLE ASSEMBLIES FOR A DOOR OF AN OVEN

(71) Applicant: WHIRLPOOL CORPORATION, Benton Harbor, MI (US)

(72) Inventors: Zachary J. Bruin-Slot, Coloma, MI (US); Rohan Gajananrao Gore, Stevensville, MI (US); Sarang Hemant Lokaksha, Pune (IN); Yogesh Vasant Sonone, Buldana (IN); Pradeep Shankar Thorat, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 454 days.

(21) Appl. No.: 18/122,769

(22) Filed: Mar. 17, 2023

(65) Prior Publication Data

US 2024/0310054 A1 Sep. 19, 2024

(51) Int. Cl.
*F24C 15/02* (2006.01)

(52) U.S. Cl.
CPC ..... *F24C 15/024* (2013.01)

(58) Field of Classification Search
CPC .. F24C 15/024; F25D 23/028; A47L 15/4257; H05B 6/6414
USPC ..... 16/422
See application file for complete search history.

(56) References Cited

U.S. PATENT DOCUMENTS 2,329,298 A 9/1943 Ring
2,681,469 A 6/1954 Condon
6,430,780 B1 8/2002 Kim et al.
7,303,784 B2 12/2007 Nonninger et al.
7,696,128 B2 4/2010 Jordens et al.
7,910,657 B2 3/2011 Cohoon-Brister
8,257,678 B2 9/2012 Steiner, III et al.
8,459,983 B2 6/2013 Belzile et al.
8,517,480 B2 8/2013 Kose et al.
8,732,910 B1 5/2014 Paul et al.
8,739,773 B2 6/2014 Ambrose et al.
9,540,243 B2 1/2017 Steiner et al.
9,663,400 B2 5/2017 O'Malley et al.
11,248,835 B1 * 2/2022 Nuss ..... F25D 27/005
(Continued)

FOREIGN PATENT DOCUMENTS

CN 201273618 Y 7/2009
CN 102864970 A 1/2013
(Continued)

OTHER PUBLICATIONS

Machine Translation of CN 103610396 (Year: 2015).*
DE 102009027731 with Machine Translation (Year: 2010).*
WO 2019114192 with Machine Translation (Year: 2019).*

*Primary Examiner* — Allen R. B. Schult
*Assistant Examiner* — Amy E Carter
(74) *Attorney, Agent, or Firm* — Price Heneveld LLP

(57) ABSTRACT

An oven including: (a) a door including (i) an external surface that faces an external environment and (ii) a mounting stud that projects from an interior of the door toward the external environment; and (b) a handle assembly comprising a handle, an attached state where the handle assembly is attached to the door through coupling with the mounting stud, a detachable state where the handle can be removed from the handle assembly, and a push-button mechanism that, when manipulated, transitions the handle assembly from the attached state to the detachable state.

20 Claims, 44 Drawing Sheets

(56) References Cited

U.S. PATENT DOCUMENTS

| | | | | |
|---|---|---|---|---|
| 2010/0101649 | A1 | 4/2010 | Huignard et al. | |
| 2012/0034472 | A1 | 2/2012 | Fich Pedersen et al. | |
| 2013/0285527 | A1 | 10/2013 | Choi et al. | |
| 2017/0183232 | A1 | 6/2017 | Steiner, III et al. | |
| 2023/0148387 | A1* | 5/2023 | Farrel | E05B 1/0015 312/293.1 |
| 2024/0077208 | A1* | 3/2024 | Nagane | F24C 15/024 |

FOREIGN PATENT DOCUMENTS

| | | | | | |
|---|---|---|---|---|---|
| CN | 103610396 | B | * | 7/2015 | |
| DE | 3644021 | A1 | | 6/1988 | |
| DE | 202007003765 | U1 | | 5/2007 | |
| DE | 102009027731 | A1 | * | 2/2010 | F25D 23/028 |
| DE | 102010003898 | A1 | | 11/2011 | |
| DE | 102011087753 | A1 | | 6/2013 | |
| DE | 102018216336 | A1 | | 3/2020 | |
| EP | 3933316 | A1 | * | 1/2022 | E05B 3/00 |
| WO | 2011128817 | A1 | | 10/2011 | |
| WO | 2017202688 | A1 | | 11/2017 | |
| WO | WO-2019114192 | A1 | * | 6/2019 | F25D 23/02 |
| WO | 2022171436 | A1 | | 8/2022 | |

* cited by examiner

SELECTIVELY DETACHABLE HANDLE ASSEMBLIES FOR A DOOR OF AN OVEN

BACKGROUND OF THE DISCLOSURE

The present disclosure generally relates to handle assemblies for an oven, and more specifically, to handle assemblies for a door of an oven that is detachable from an external environment.

An oven sometimes includes a door and a handle attached to the door. The handle allows a user to more easily open and close the door compared to if the door lacked a handle. The user may, at some point, desire to replace the handle.

However, there is a problem in that the user cannot replace the handle from the exterior of the oven. Rather, the user typically first has to remove the door from a cabinet of the oven, and then second remove set screws at an inside portion of the door to release the handle from the door. The user may find that to be a difficult process.

SUMMARY OF THE DISCLOSURE

The present disclose addresses that problem with several handle assemblies that can be manipulated from an attached state to a detachable state where the handle assembly is separable from the oven from the external environment.

According to one aspect of the present disclosure, an oven comprises: (a) a door comprising (i) an external surface that faces an external environment and (ii) a mounting stud that projects from an interior of the door toward the external environment; and (b) a handle assembly comprising a handle, an attached state where the handle assembly is attached to the door through coupling with the mounting stud, a detachable state where the handle assembly can be removed from the door, and a push-button mechanism that, when manipulated, transitions the handle assembly from the attached state to the detachable state.

According to another aspect of the present disclosure, an oven comprises: (a) a door comprising (i) an external surface that faces an external environment and (ii) a mounting stud that projects toward the external environment from an interior of the door; and (b) a handle assembly comprising a handle, an attached state where the handle assembly is attached to the door through coupling with the mounting stud, a detachable state where the handle assembly can be removed from the door, and a push-button mechanism manipulable from an end of the handle that, when manipulated, transitions the handle assembly from the attached state to the detachable state.

According to yet another aspect of the present disclosure, an oven comprises: (a) a door comprising (i) an external surface that faces an external environment and (ii) a mounting stud that projects from an interior of the door toward the external environment; and (b) a handle assembly comprising a handle, an attached state where the handle assembly is attached to the door through coupling with the mounting stud, a detachable state where the handle can be removed from the handle assembly, and a snap-fit feature accessible to manipulate at the handle assembly that, when manipulated, transitions the handle assembly from the attached state to the detachable state.

These and other features, advantages, and objects of the present disclosure will be further understood and appreciated by those skilled in the art by reference to the following specification, claims, and appended drawings.

Figure 1:
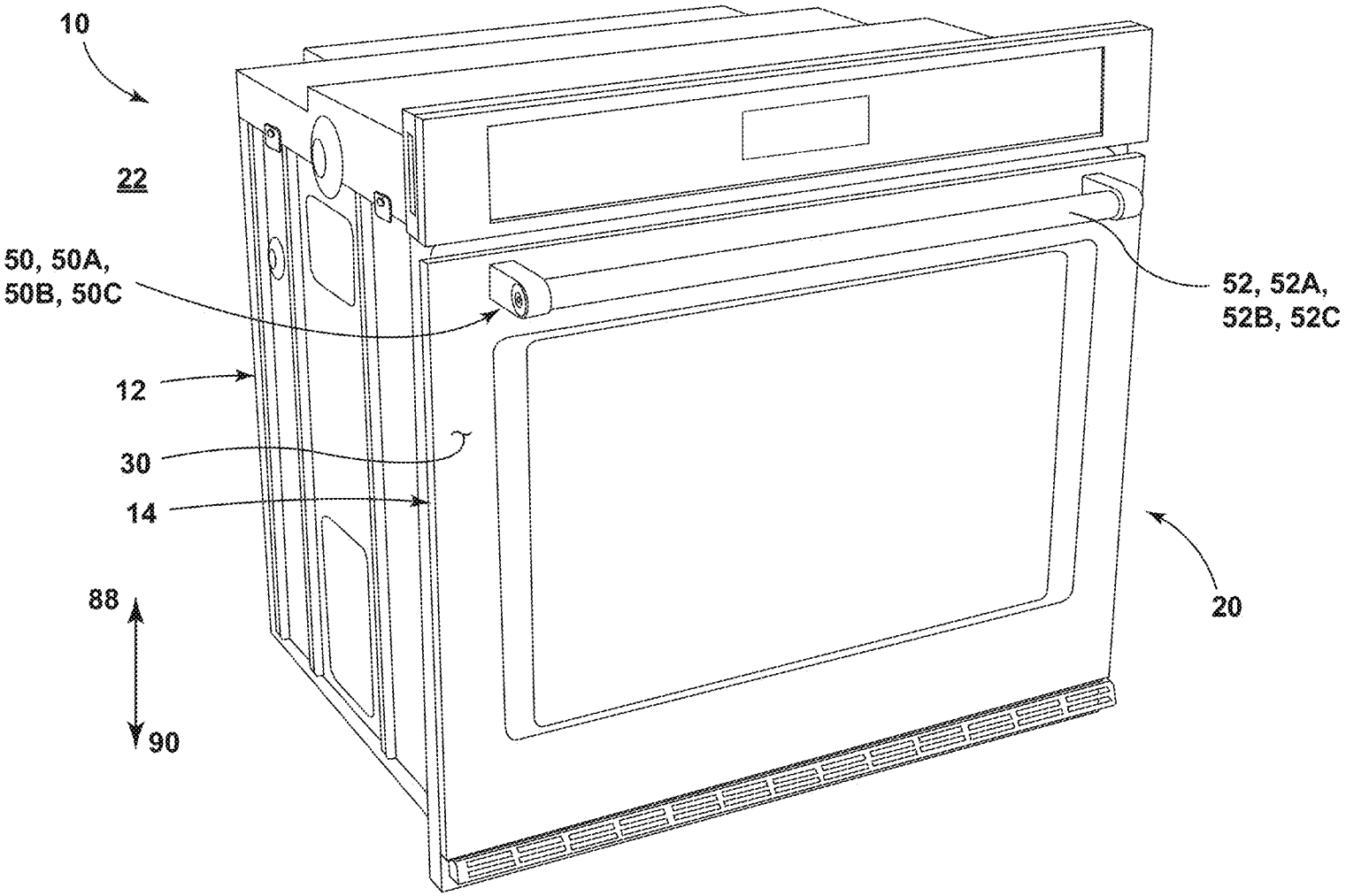
FIG. 1 is a perspective view of an oven, illustrating a door and a handle assembly attached to the door.

The components in the figures are not necessarily to scale, emphasis instead being placed upon illustrating the principles described herein.

DETAILED DESCRIPTION

The present illustrated embodiments reside primarily in combinations of method steps and apparatus components related to handle assemblies of an oven. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
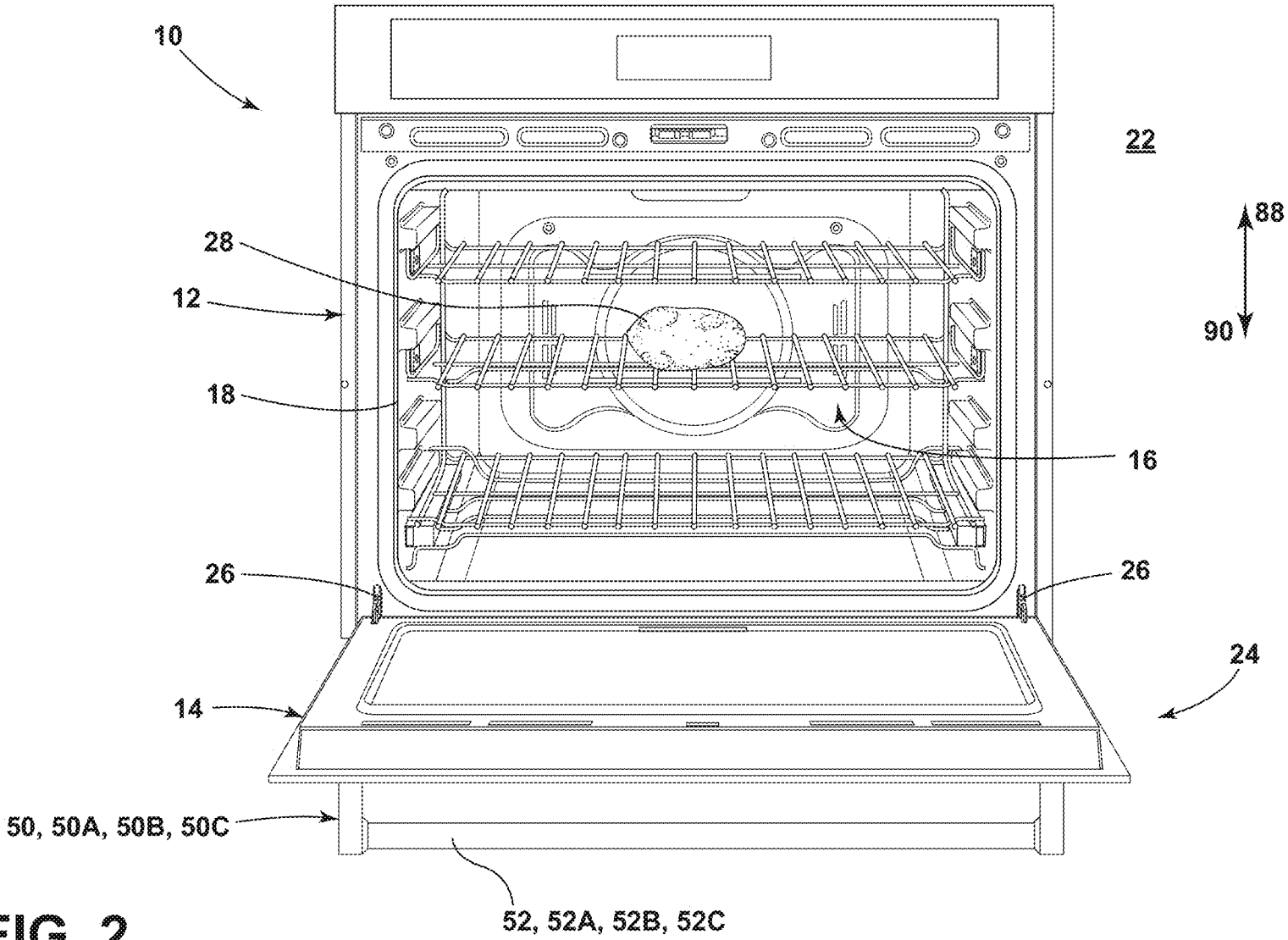
FIG. 2 is an elevation view of the oven of FIG. 1, illustrating the door in an open position.

Referring to FIGS. 1 and 2, an oven 10 includes a cabinet 12 and a door 14 attached to the cabinet 12. The cabinet 12 defines a cooking chamber 16 and an opening 18 into the cooking chamber 16. The door 14 provides selective access to cooking chamber 16. The door 14 can be manipulated to, from, and between a closed position 20 (FIG. 1) where access to the cooking chamber 16 from an external environment 22 is denied and an open position 24 (FIG. 2) where access to the cooking chamber 16 from the external environment 22 is allowed. The door 14 can be attached to the cabinet 12 via hinges 26. The oven 10 includes at least one heating element (not illustrated) to increase the temperature of air within the cooking chamber 16. The temperature of the air can be increased, for example, to subject a food item 28 to a cooking operation. The door 14 includes an external surface 30 that faces the external environment 22.

Figure 3:
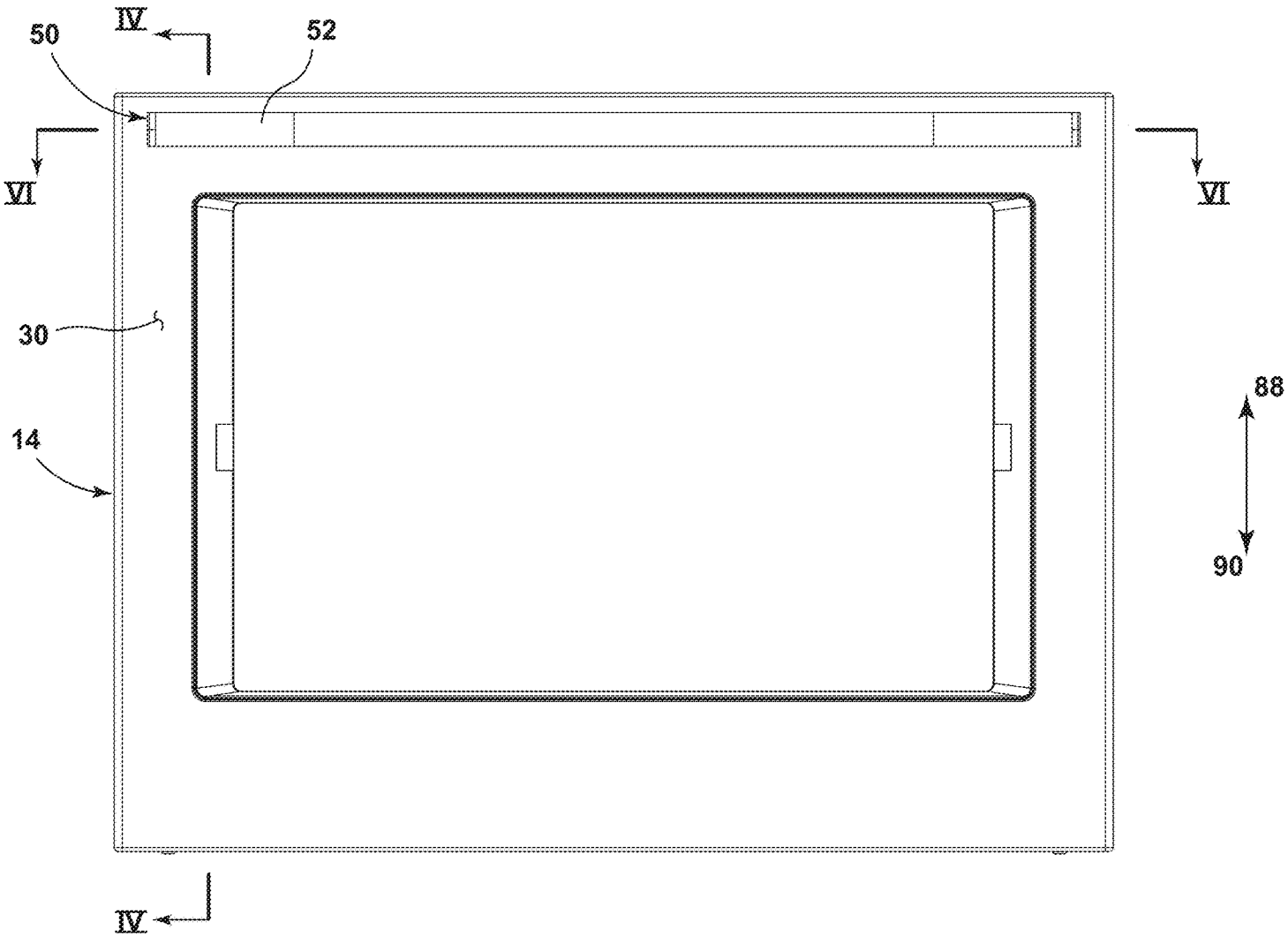
FIG. 3 is an elevation view of the door of FIG. 1 with an embodiment of a handle assembly of the present disclosure.
Figure 4:
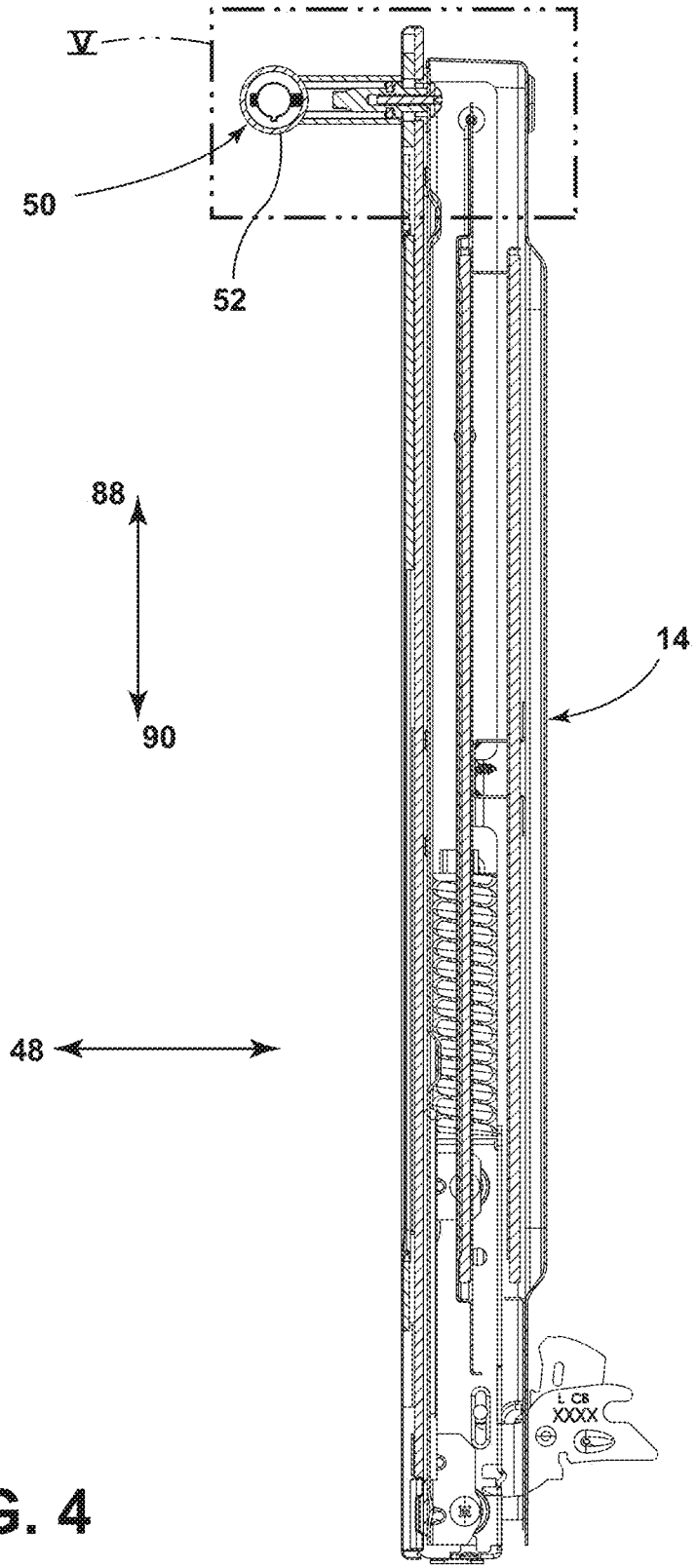
FIG. 4 is an elevation view of a cross-section of the door of FIG. 3 taken through line IV-IV of FIG. 3.
Figure 5:
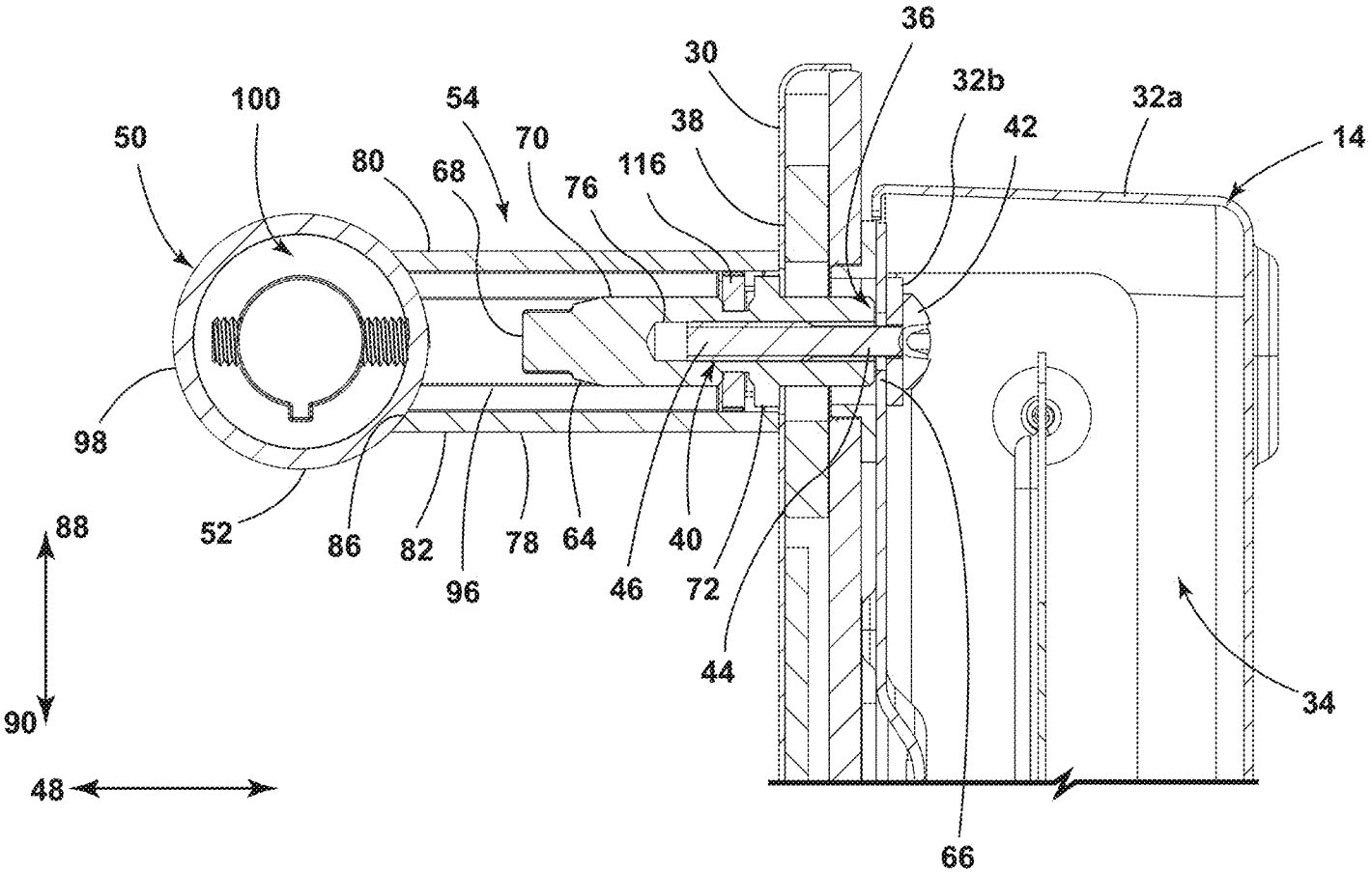
FIG. 5 is a magnified view of area V of FIG. 4, illustrating the handle assembly attached to the door via a mounting stud.
Figure 6:
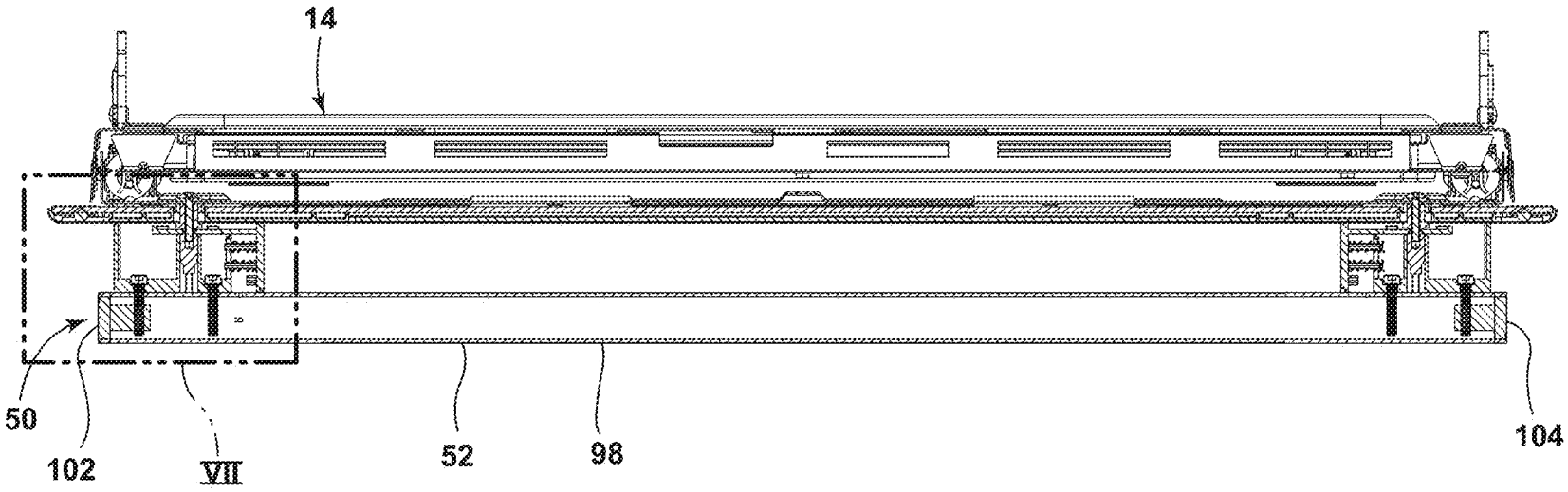
FIG. 6 is an overhead view of a cross-section of the door of FIG. 3 taken through line VI-VI of FIG. 3.

Referring now to FIGS. 3-5, the door 14 further includes structural components 32*a*, 32*b*, 32*c*, . . . 32*n* that form an interior 34 within the door 14. The door 14 includes an aperture 36 that is open within the interior 34 and open at a component 38 of the door 14 providing the external surface 30. The aperture 36 can extend through multiple components of the door 14, such as the components 32*b*, 38. The door 14 further includes a mounting stud 40. The mounting stud 40 includes a head 42 within the interior 34 of the door 14, a shank 44 extending from the head 42, and a threaded end 46 extending from the shank 44. The head 42 has a diameter that is larger than aperture 36 of the structural component 32*b* of the door 14 through which the mounting stud 40 is located at the interior 34. Portions of the aperture 36 closer to the external environment 22 can have a diameter larger than the diameter of the component forming the portion of the aperture 36 open at the interior 34 of the door 14. The shank 44 projects forward 48 from the head 42 disposed within the interior 34 through the aperture 36 toward the external environment 22. The threaded end 46 can terminate within the aperture 36 or extend beyond the external surface 30 of the door 14. The component 38 of the door 14 providing the external surface 30 of the door 14 can be a wrapper made of metal, such as stainless steel.

The oven 10 further includes a handle assembly 50. The handle assembly 50 includes a handle 52. The handle assembly 50 includes, and can move to, from, and between, (i) an attached state 54 (see, e.g., FIGS. 5 and 7), (ii) a detachable state 56 (see, e.g., FIG. 8), and (iii) a detached state 58 (see, e.g., FIG. 9). In the attached state 54, the handle assembly 50 is attached to the door 14 through coupling with the mounting stud 40. In the detachable state 56, the handle assembly 50 can be removed from the door 14, such as with the application of a force 60 that pulls the handle assembly 50 away from the door 14. Finally, in the detached state 58, the handle assembly 50 is no longer coupled to the mounting stud 40 and is not touching the door 14. For example, while initially in the detachable state 56, the force 60 successfully pulled the handle assembly 50 away from the door 14 to the detached state 58.

In embodiments, the handle assembly 50 includes a push-button mechanism 62 (see additionally FIGS. 7-18). The push-button mechanism 62, when manipulated, transitions the handle assembly 50 from the attached state 54 to the detachable state 56. For example, in embodiments, the oven 10 further includes a bushing 64 (see particularly FIGS. 10 and 11). The bushing 64 includes a door end 66, a handle end 68, and a body portion 70 extending between the door end 66 and the handle end 68. The door end 66 extends into the aperture 36 of the door 14. The handle end 68 projects away from the aperture 36 and the external surface 30 of the door 14. The handle end 68 projects toward the handle 52, when the handle assembly 50 is in the attached state 54 and the detachable state 56.

The bushing 64 further includes a flange 72 and a recess 74. The flange 72 projects radially outward from the body portion 70. The recess 74 is disposed adjacent to the flange 72 between the flange 72 and the handle end 68. The recess 74 is recessed radially inward into the body portion 70. The bushing 64 further includes a receiving cavity 76. The receiving cavity 76 is open at the door end 66. The mounting stud 40 projects into the receiving cavity 76 (see, e.g., FIGS. 7-9) in a fastening manner to fasten the bushing 64 to the door 14. For example, one or both of the mounting stud 40 and the receiving cavity 76 can be threaded to facilitate fastening of the bushing 64 to the mounting stud 40.

Figure 12:
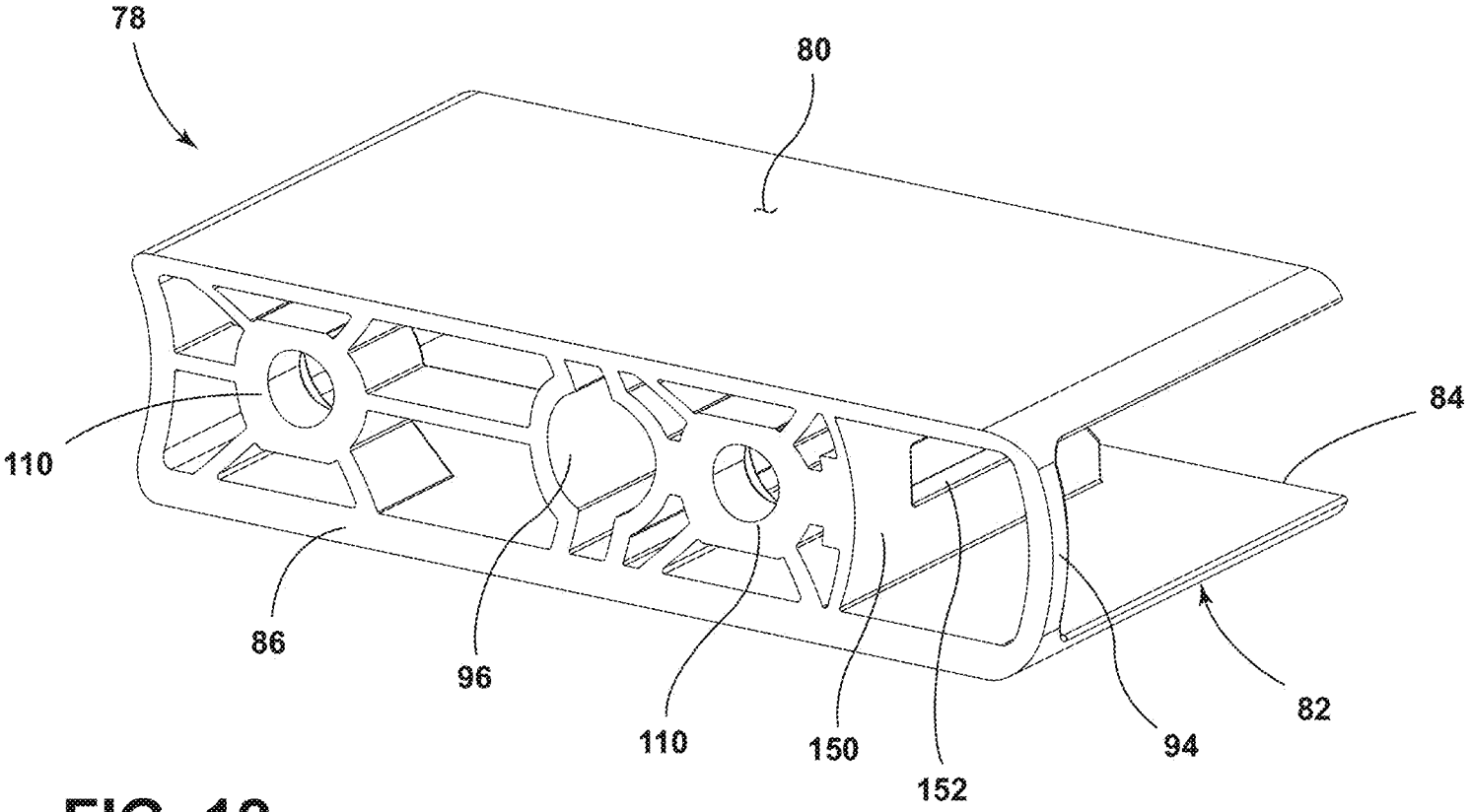
FIG. 12 is a perspective view of a standoff of the handle assembly of FIG. 3, illustrating the standoff having a bushing receiver.
Figure 13:
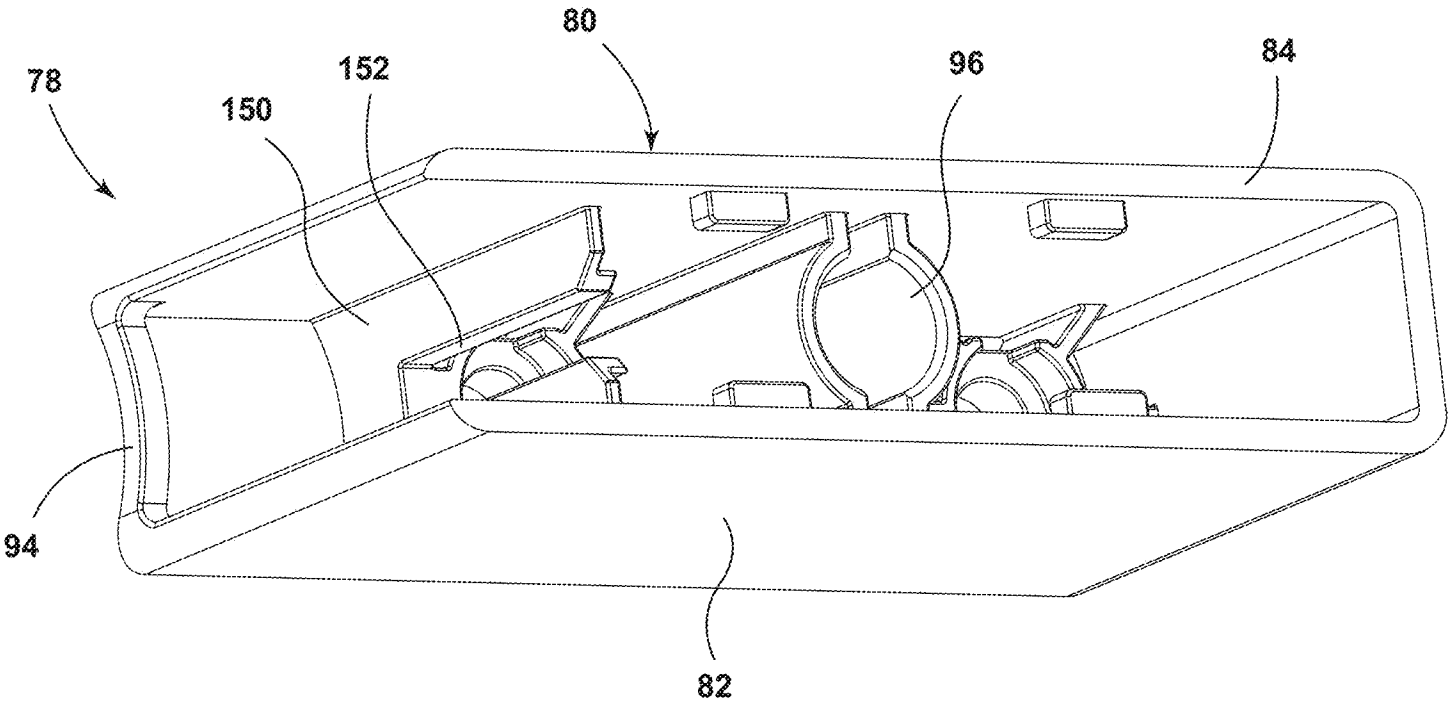
FIG. 13 is a perspective view of the standoff of FIG. 12, illustrating the standoff further including a spring barrier wall and a slot through the spring barrier wall.
Figure 14:
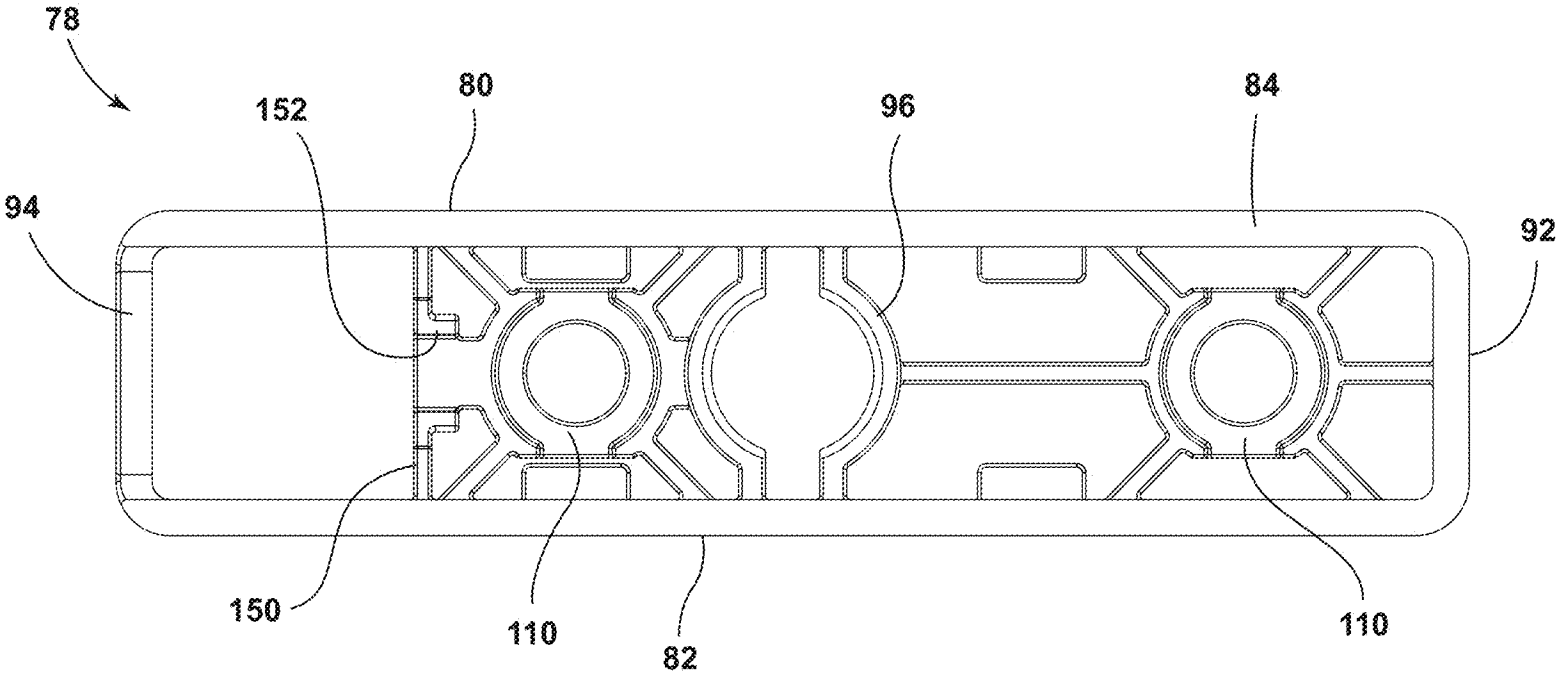
FIG. 14 is an elevation view of the standoff of FIG. 12, illustrating the standoff further including apertures for fasteners.
Figure 15:
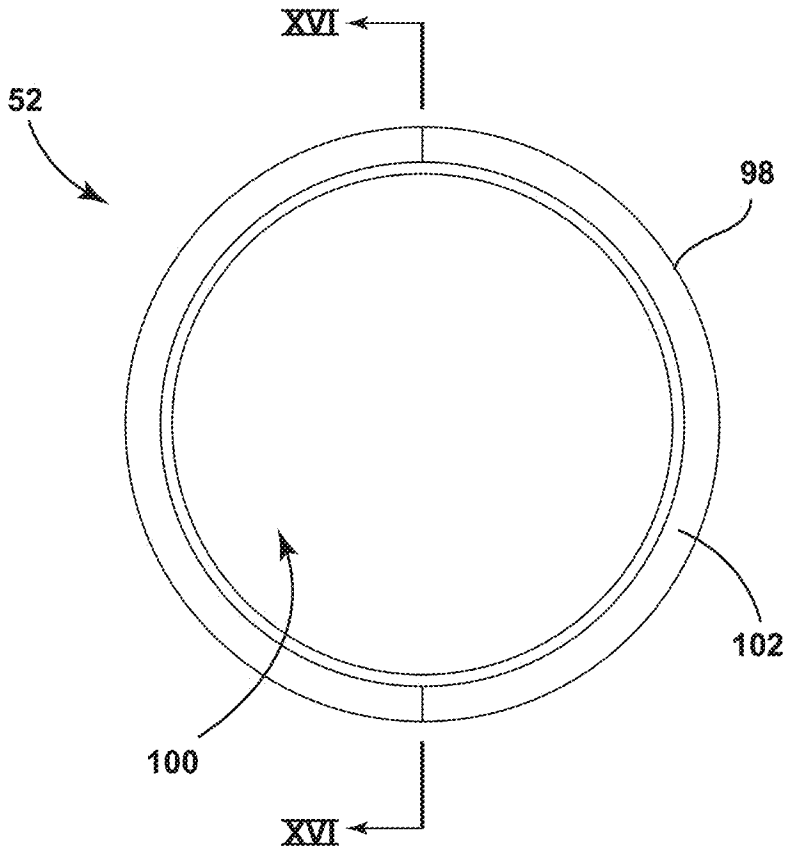
FIG. 15 is an elevation view of a handle of the handle assembly of FIG. 3, illustrating the handle including a hollow cylinder.
Figure 16:
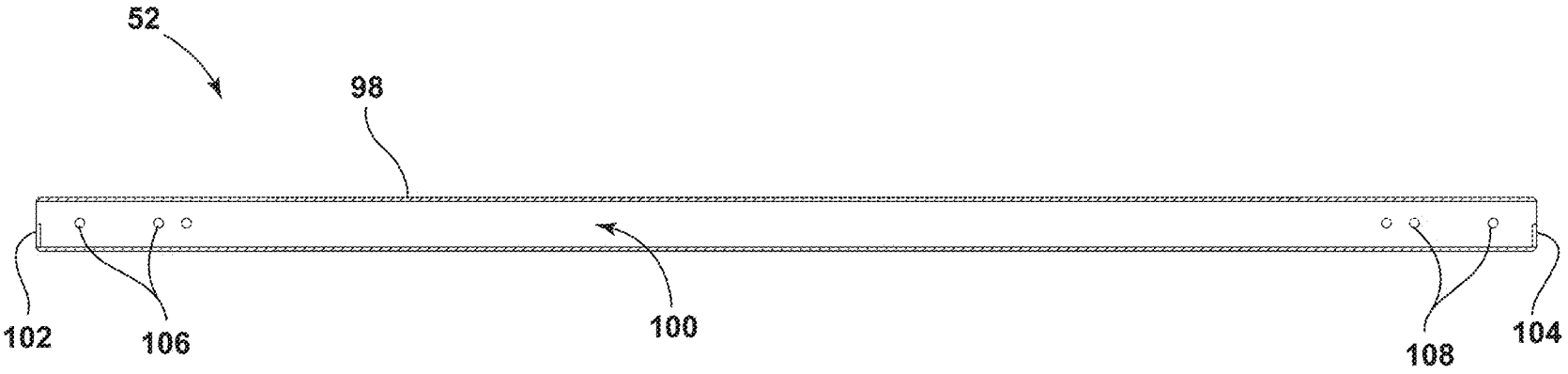
FIG. 16 is an overhead view of a cross-section of the handle of FIG. 15 taken through line XVI-XVI of FIG. 15, illustrating the handle including a pair of apertures disposed at a first end of the handle.

In embodiments, the handle assembly 50 further includes a standoff 78 (see, e.g., FIGS. 12-14). The standoff 78 is disposed between the handle 52 and the external surface 30 of the door 14. The standoff 78 includes a top surface 80, a bottom surface 82, a door edge 84, and a handle edge 86. The top surface 80 faces upwards 88, when the door 14 is in the closed position 20. The bottom surface 82 faces downwards 90, when the door 14 is in the closed position 20. The handle edge 86 faces the handle 52. The handle edge 86 can contact the handle 52. The handle edge 86 can be contoured to match a contour of the handle 52. The standoff 78 further includes two lateral sides 92, 94 that face in opposite directions.

The standoff 78 further includes a bushing receiver 96. The bushing receiver 96 is disposed elevationally (from the perspective of when the door 14 is in the closed position 20) between the top surface 80 and the bottom surface 82. The bushing receiver 96 is disposed between the two lateral sides 92, 94. The bushing receiver 96 is disposed between the handle edge 86 and the door edge 84. The bushing receiver 96 is open at the door edge 84. The bushing receiver 96 is sized and shaped to receive the bushing 64 attached to the mounting stud 40 when the handle 52 is in the attached state 54. The bushing receiver 96 can be slightly smaller than the bushing 64 so that the bushing 64 friction fits within, but is still separable from, the bushing receiver 96. However, the bushing receiver 96 can release from the bushing 64 while the handle 52 is pulled away from the door 14 when the handle assembly 50 is in the detachable state 56 to transition to the detached state 58. Likewise, the bushing receiver 96 can receive the bushing 64 as the handle assembly 50 transitions from the detached state 58 to the detachable state 56 (and ultimately the attached state 54).

In embodiments, the handle 52 includes (see, e.g., FIGS. 15-16) a hollow cylinder 98. As a hollow cylinder 98, there is a cavity 100 disposed within the handle 52. The hollow cylinder 98 includes a first end 102 and a second end 104. The hollow cylinder 98 further includes a pair of apertures 106 through the hollow cylinder 98. The pair of apertures 106 are disposed closer to the first end 102 of the hollow cylinder 98 than to the second end 104 (e.g., near the first end 102). The hollow cylinder 98 further includes a pair of apertures 108 disposed closer to the second end 104 of the hollow cylinder 98 than to the first end 102 (e.g., near the second end 104).

The standoff 78 further includes a pair of apertures 110. The pair of apertures 110 are disposed elevationally (from the perspective of when the door 14 is in the closed position 20) between the top surface 80 and the bottom surface 82. The pair of apertures 110 of the standoff 78 are aligned with the pair of apertures 106 of the handle 52. A pair of fasteners 112 extend through the pair of apertures 110 of the standoff 78 and then through the pair of apertures 106 of the handle 52 to fasten the standoff 78 and the handle 52 together.

Figure 17:
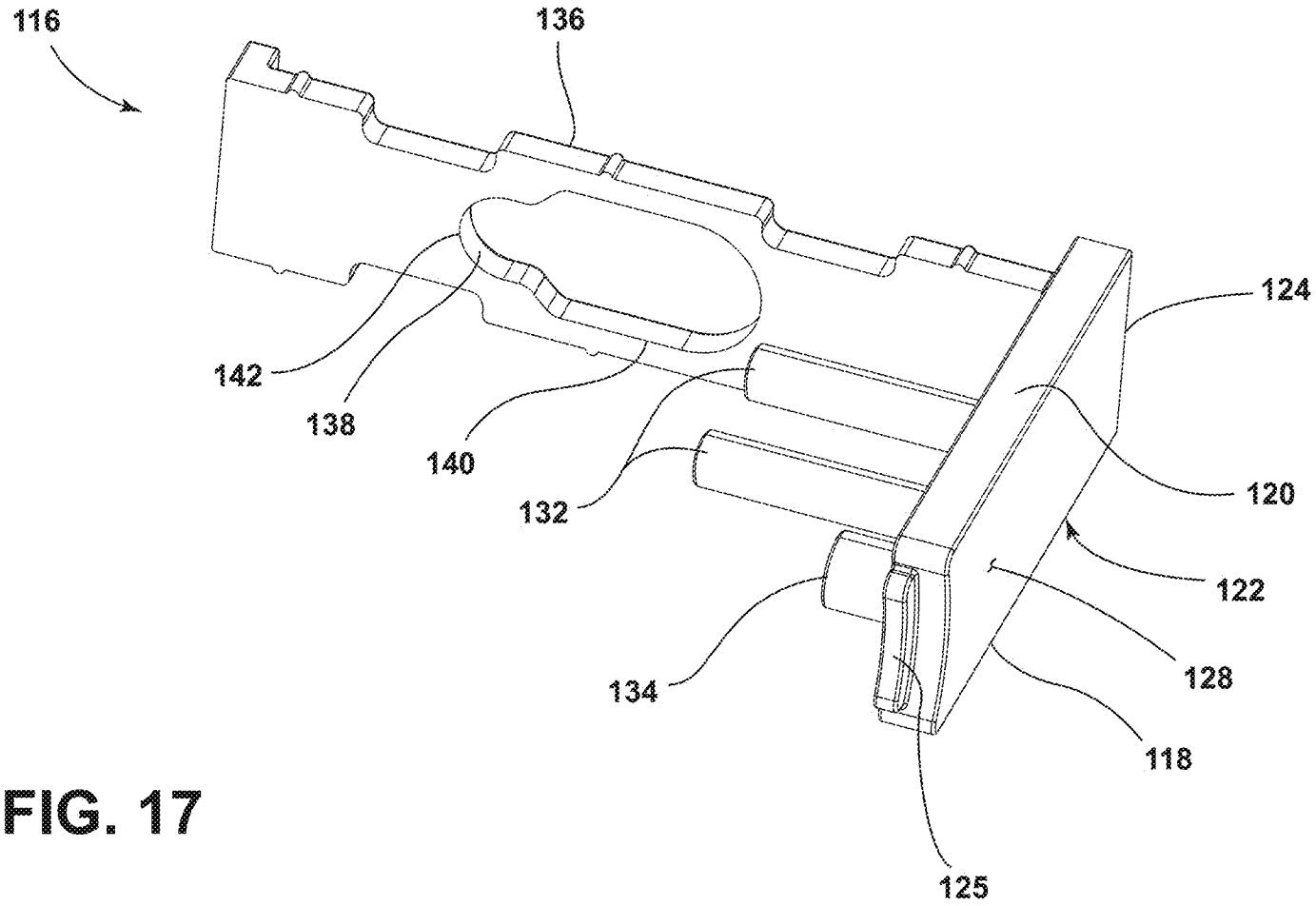
FIG. 17 is a perspective view of a push-button body of the handle assembly of FIG. 3, illustrating a button wall and a locking wall extending orthogonally to the button wall.
Figure 18:
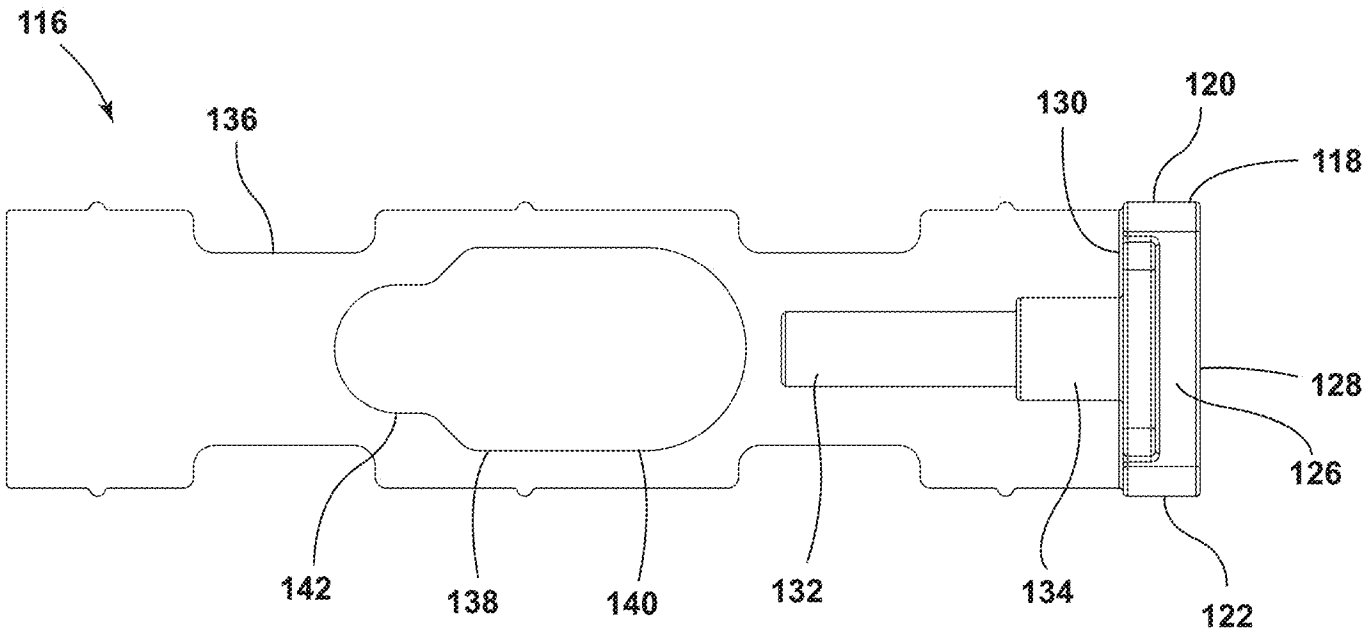
FIG. 18 is an elevation view of the push-button body of FIG. 17, illustrating a locking aperture through the locking wall.
Figure 19:
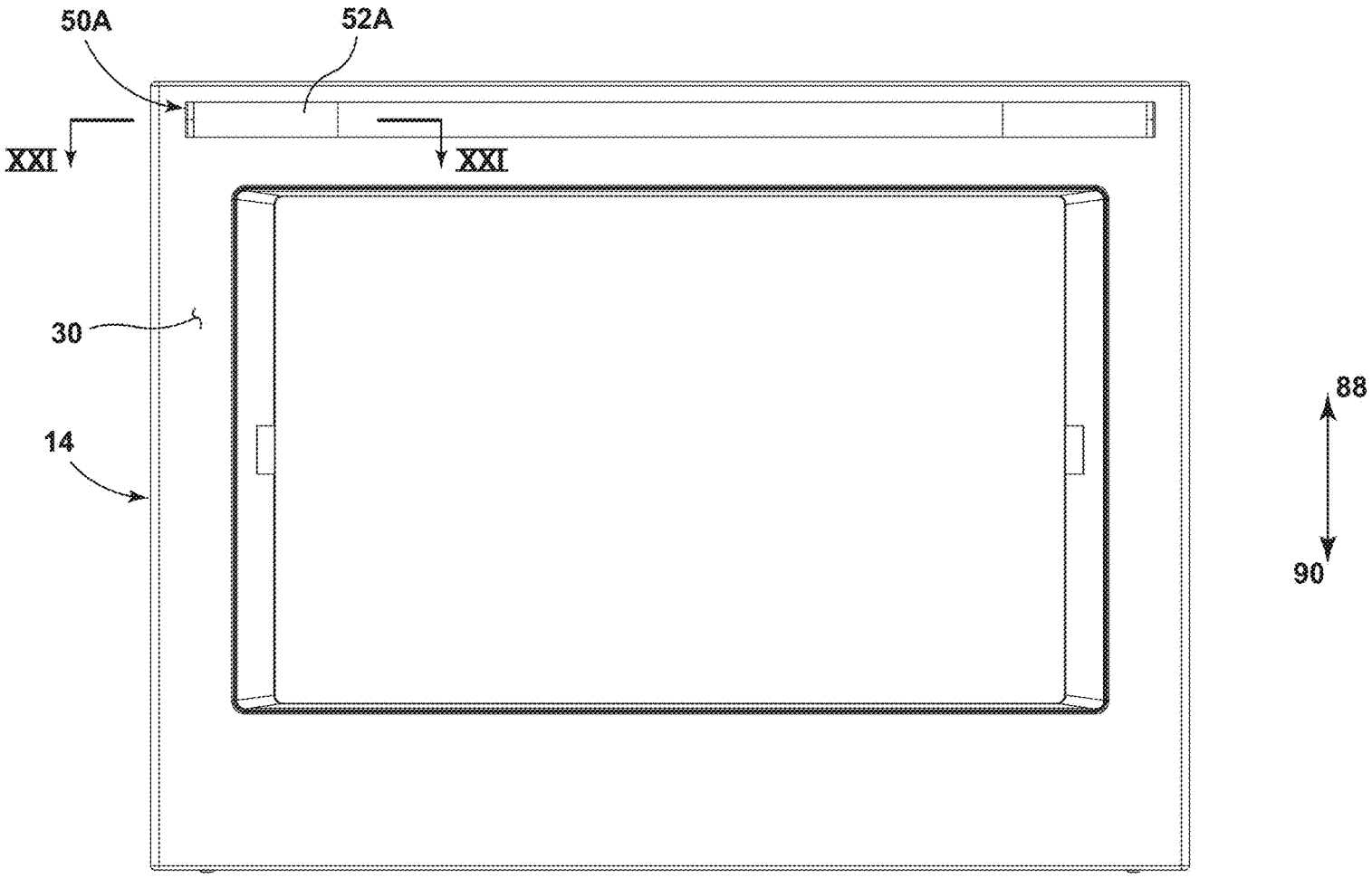
FIG. 19 is an elevation view of the door of FIG. 1 with another embodiment of a handle assembly of the present disclosure.
Figure 20:
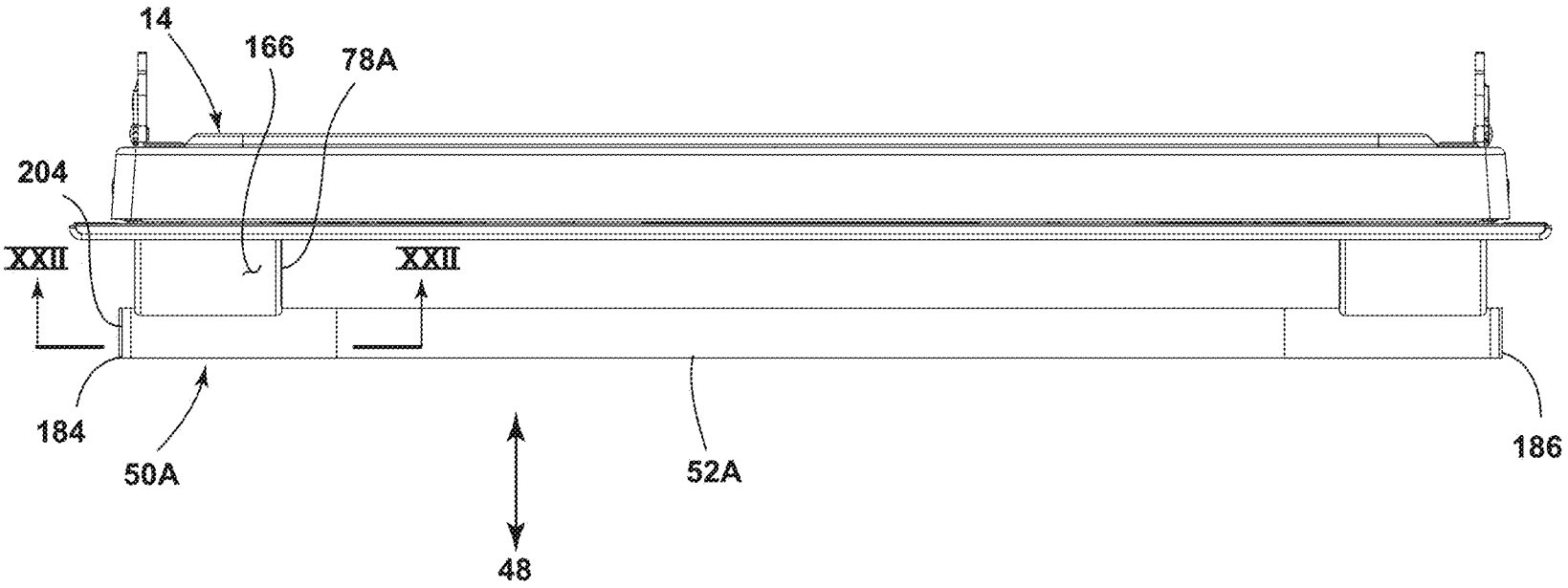
FIG. 20 is an overhead view of the door of FIG. 19.
Figure 21:
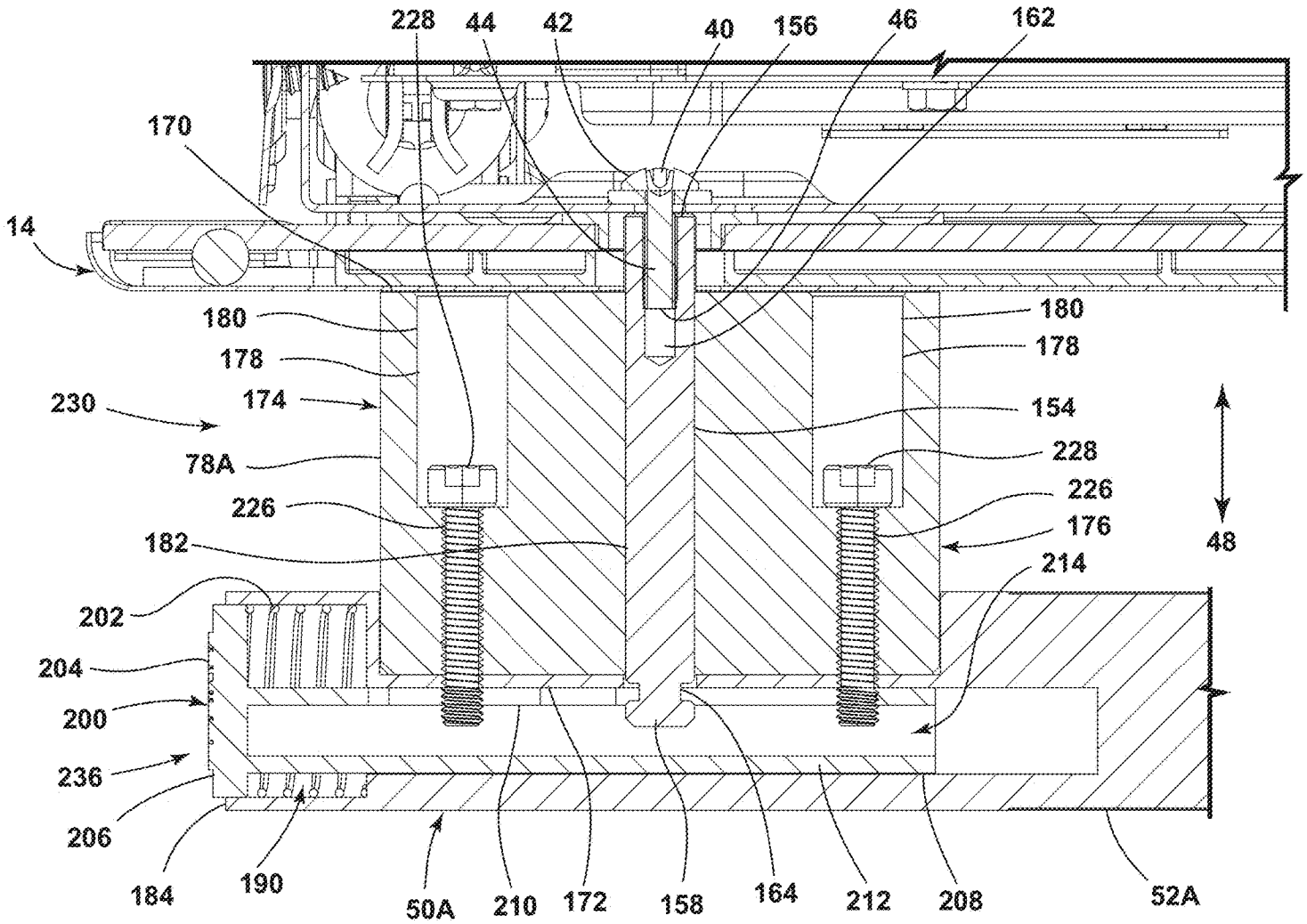
FIG. 21 is an overhead view of a cross-section of the door of FIG. 19 taken through line XXI-XXI of FIG. 19, illustrating the handle assembly in an attached state attached to the mounting stud of the door via an anchor cylinder.
Figure 22:
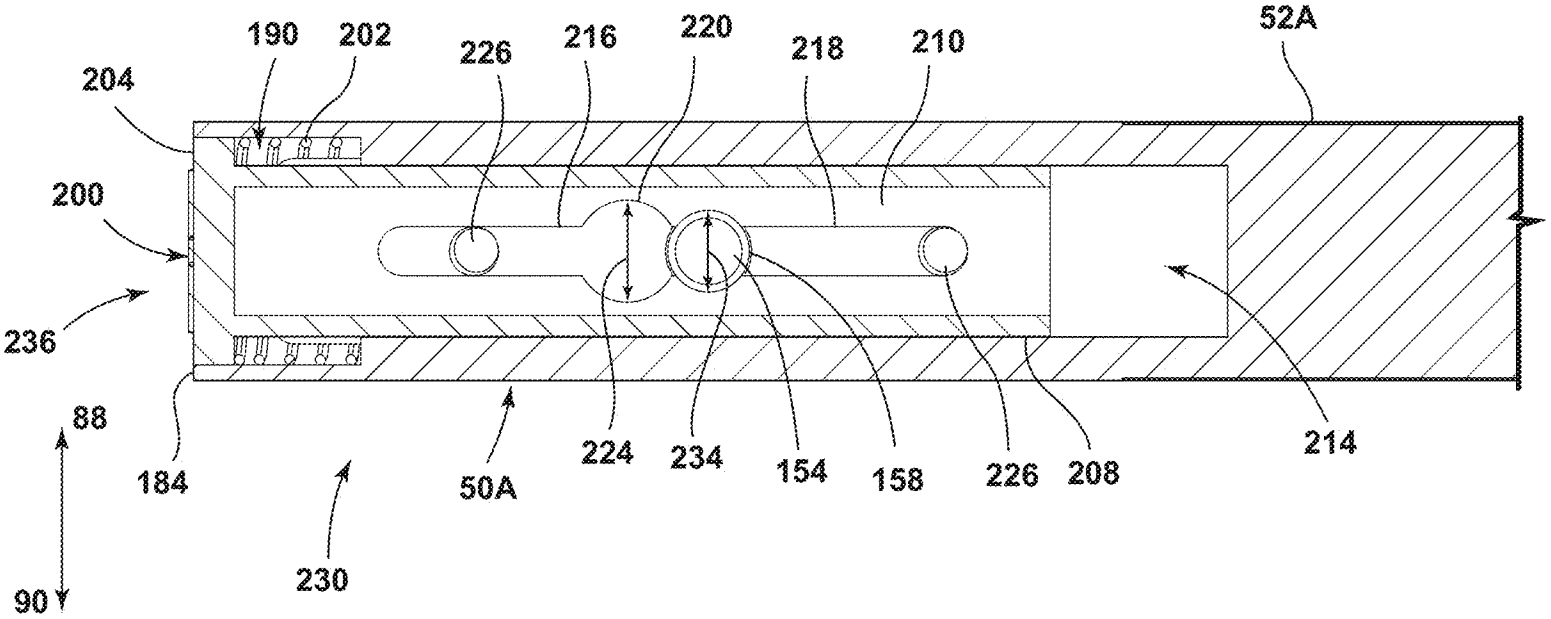
FIG. 22 is an elevation view of a cross-section of the door of FIG. 19 taken through line XXII-XXII of FIG. 20, illustrating the anchor cylinder cooperating with a locking section of an anchor aperture of a push-button body of a push-button mechanism of the handle assembly to place the handle assembly in the attached state attached to the door.

The push-button mechanism 62 includes a pair of compression springs 114 (see, e.g., FIGS. 7-9) and a push-button body 116 (see., e.g., FIGS. 17-18). The push-button body 116 includes a button wall 118. The button wall 118 has a top edge 120, a bottom edge 122, a rear edge 124, a forward edge 126, an outside surface 128, and an inside surface 130. The top edge 120 faces upwards 88, when the door 14 is in the closed position 20. The bottom edge 122 faces downwards 90, when the door 14 is in the closed position 20. The rear edge 124 faces the external surface 30 of the door 14. The forward edge 126 faces the handle 52. The outside surface 128 faces the external environment 22. The inside surface 130 faces away from the outside surface 128.

The push-button body 116 further includes a pair of projections 132 and another projection 134. The pair of projections 132 extend from the inside surface 130 of the button wall 118 away from the outside surface 128 of the button wall 118. The pair of compression springs 114 are disposed around the pair of projections 132. The other projection 134 extends from the inside surface 130 of the button wall 118 away from the outside surface 128 of the button wall 118.

The push-button body 116 further includes a locking wall 136. The locking wall 136 extends from the inside surface 130 of the button wall 118 away from the outside surface 128 of the button wall 118. The locking wall 136 and the button wall 118 are substantially orthogonal relative to each other. The locking wall 136 includes a locking aperture 138 therethrough. The locking aperture 138 has an unlocking portion 140 and a locking portion 142. The locking portion 142 is disposed further away from the inside surface 130 of the button wall 118 than the unlocking portion 140. The locking portion 142 can be narrower than the unlocking portion 140.

Figure 7:
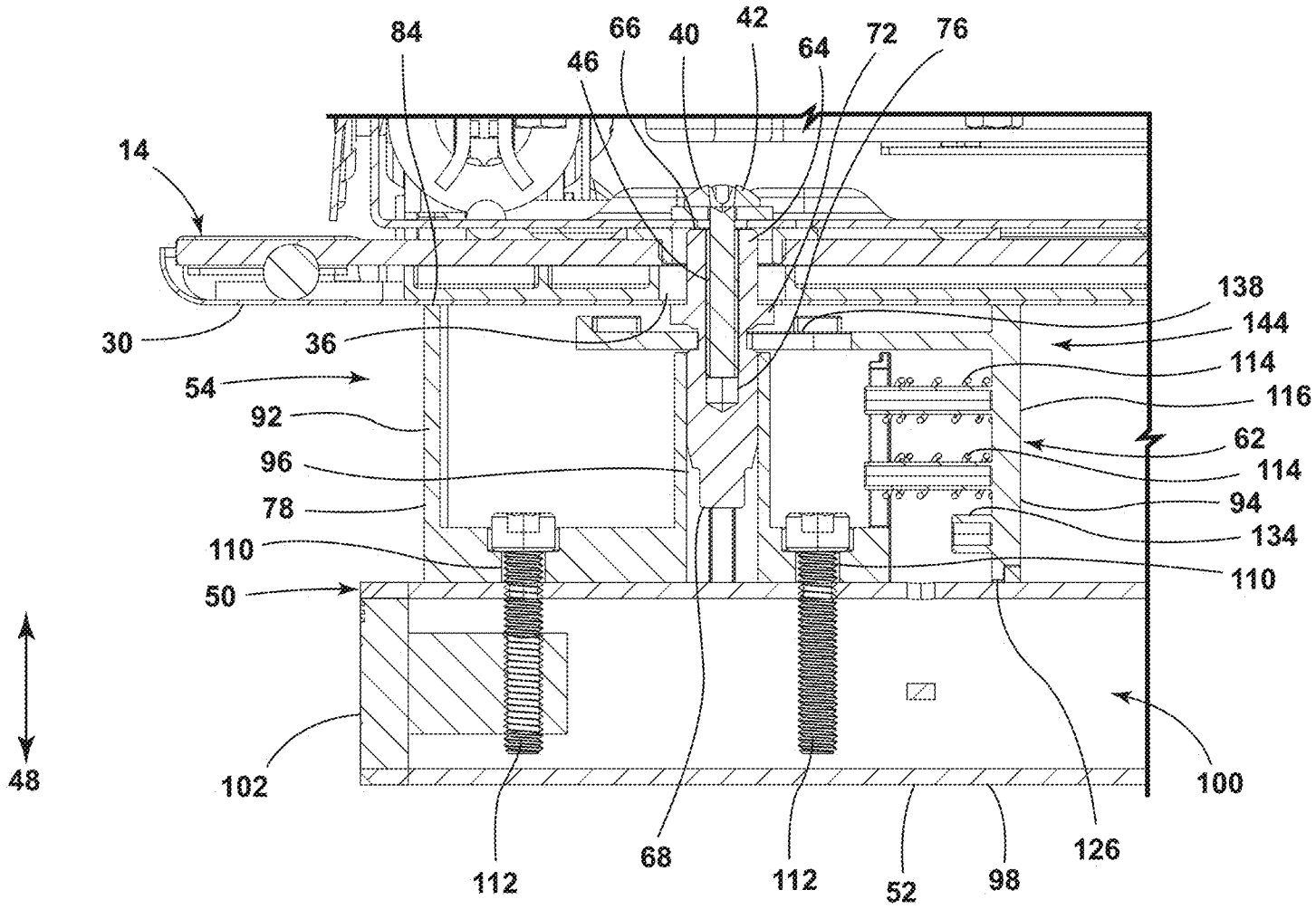
FIG. 7 is a magnified view of area VII of FIG. 6, illustrating the handle assembly in an attached state attached to the door and the handle assembly including a push-button mechanism in a relaxed state.
Figure 8:
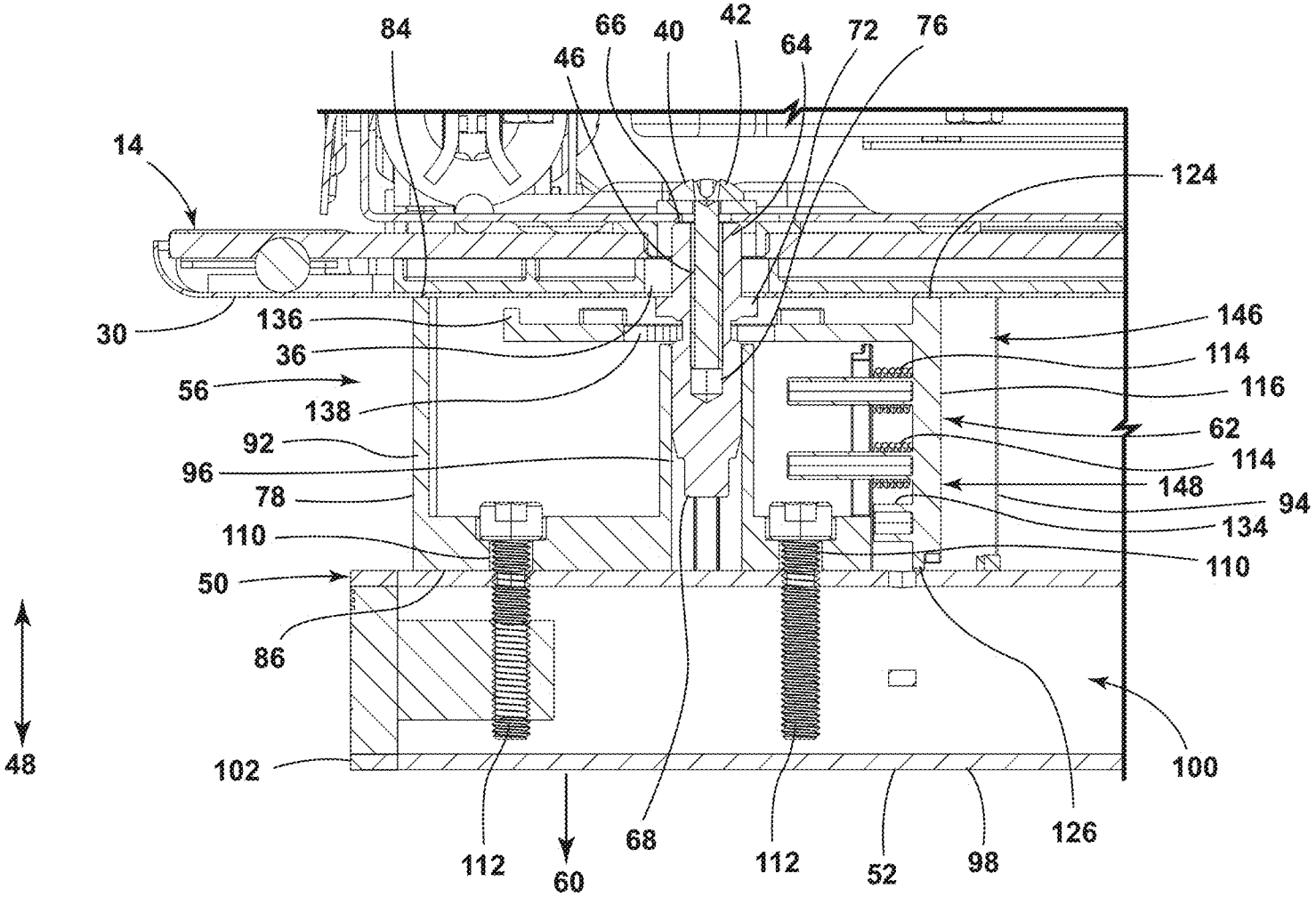
FIG. 8 is the same view as FIG. 7 but this time illustrating the handle assembly in a detachable state, where the handle assembly is separable from the door, as a result of the push-button mechanism being manipulated to a pushed position.
Figure 9:
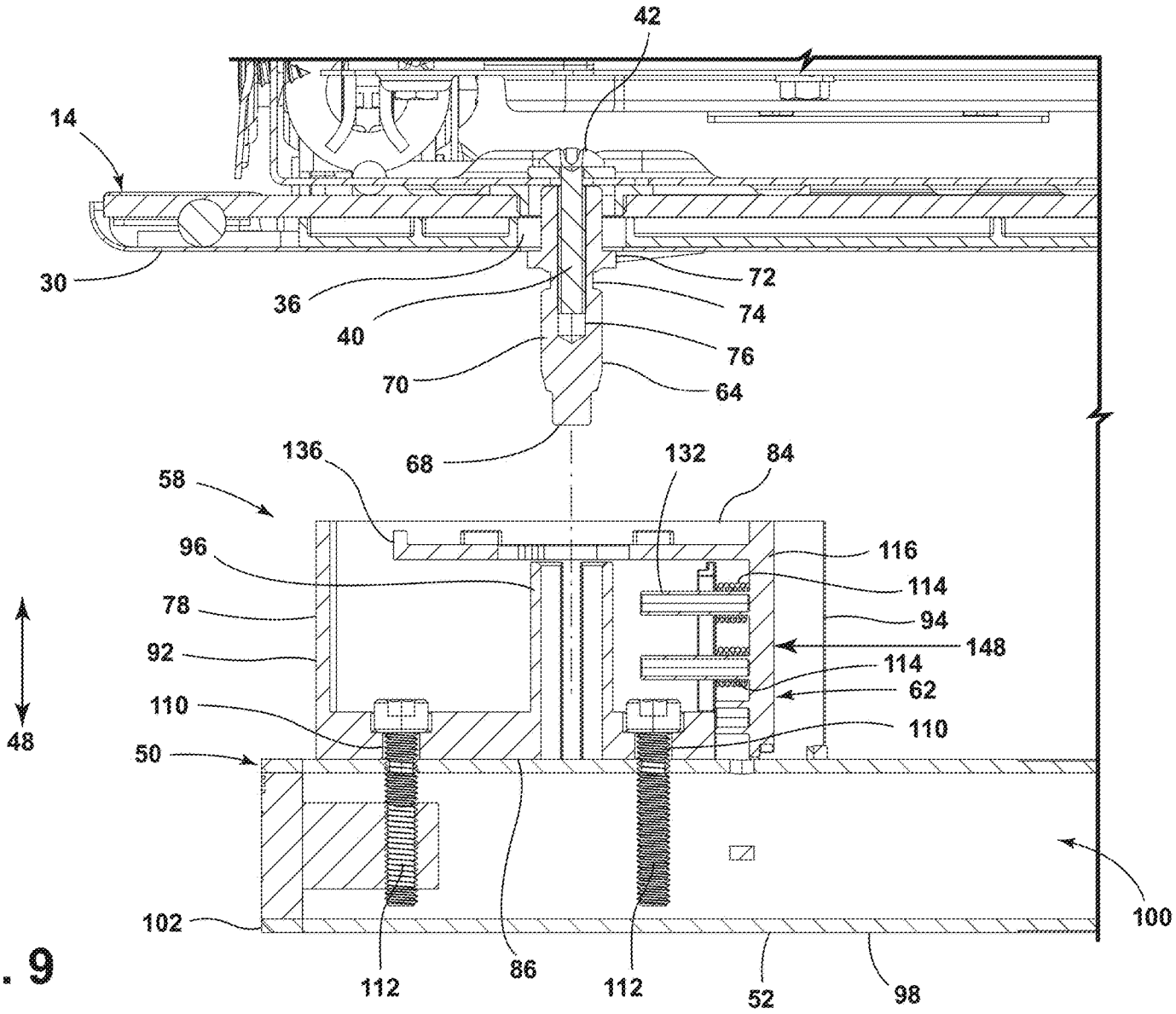
FIG. 9 is the same view as FIG. 7 but this time illustrating the handle assembly in a detached state separated from the door.
Figure 10:
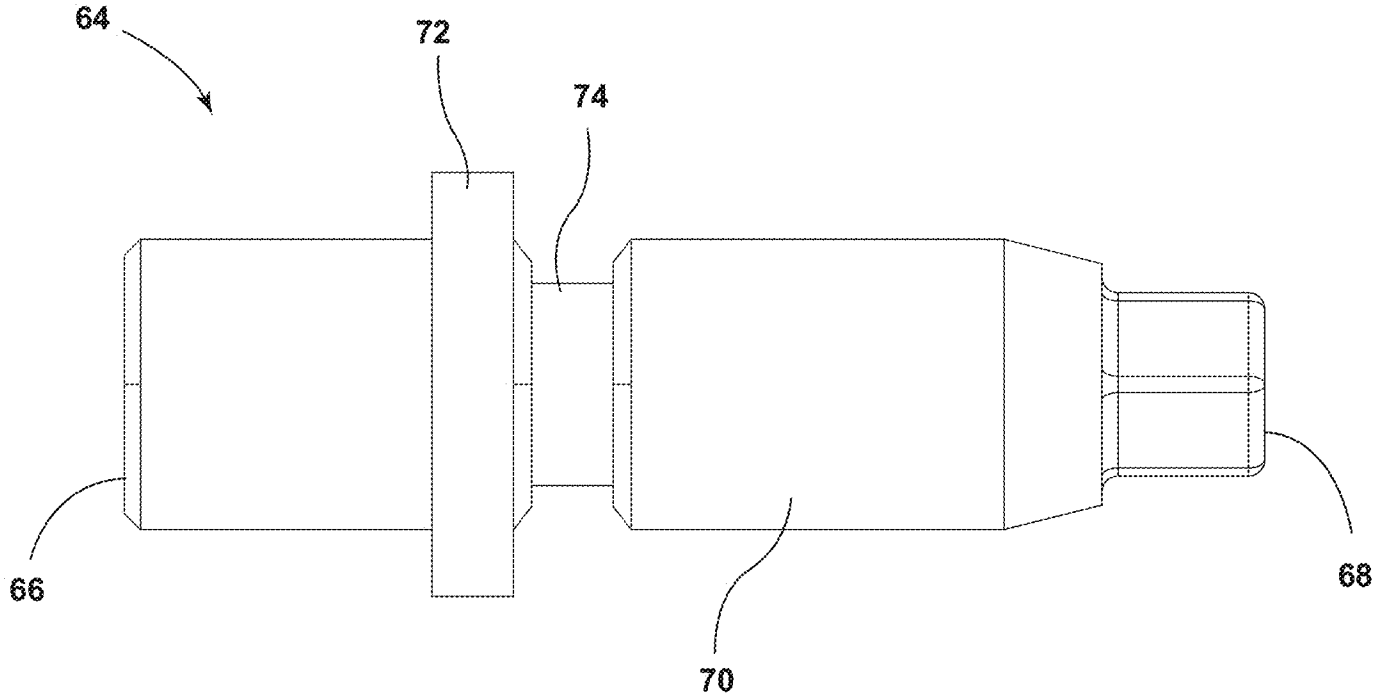
FIG. 10 is an elevation view of a bushing of the handle assembly of FIG. 3, illustrating the bushing having a flange and a recess next to the flange.
Figure 11:
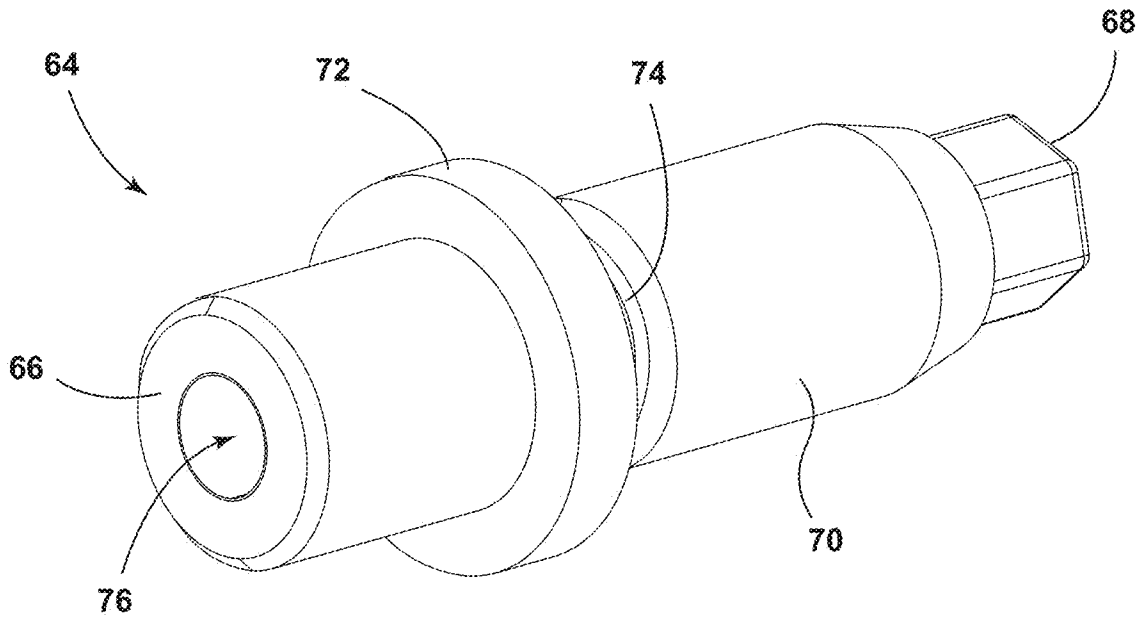
FIG. 11 is a perspective view of the bushing of FIG. 10, illustrating a door end of the bushing having a receiving cavity.

The standoff 78 houses the push-button mechanism 62 (see FIGS. 7-9). The push-button body 116 is disposed between the top surface 80 and the bottom surface 82 of the standoff 78. The button wall 118 of the push-button body 116 is disposed at the lateral side 94 of the standoff 78. The rear edge 124 of the button wall 118 is aligned with the door edge 84 of the standoff 78. The forward edge 126 of the button wall 118 is disposed near the handle edge 86 of the standoff 78. The locking wall 136 of the push-button body 116 extends laterally near the door edge 84 of the standoff 78 toward the lateral side 92 of the standoff 78. The locking aperture 138 through locking wall 136 is aligned with the bushing receiver 96 of the standoff 78.

When the handle assembly 50 is in the attached state 54, the body portion 70 of the bushing 64 extends through the locking aperture 138 of the push-button body 116 and into the bushing receiver 96 of the standoff 78. The door end 66 of the bushing 64 resides with the bushing receiver 96 of the standoff 78.

The push-button body 116 has and can move to, from, and between, a relaxed position 144 (see, e.g., FIG. 7) and a pushed position 146 (see, e.g., FIG. 8). In the relaxed position 144, the push-button body 116 is not being manipulated by a force 148 external to the oven 10 that would otherwise move the push-button body 116 in the pushed position 146. The standoff 78 further includes a spring barrier wall 150 opposing the inside surface 130 of the button wall 118. The pair of compression springs 114 are disposed between the spring barrier wall 150 and the inside surface 130 of the button wall 118. The pair of compression springs 114 thus bias the push-button body 116 to the relaxed position 144.

When the push-button body 116 is in the relaxed position 144 and the handle assembly 50 is in the attached state 54, the bushing 64 extends through the locking aperture 138 of the locking wall 136. The locking portion 142 of the locking aperture 138 cooperates with the bushing 64 to secure the handle assembly 50 to the door 14. More specifically, the locking portion 142 of the locking aperture 138 at least partially resides within the recess 74 of the bushing 64. The flange 72 of the bushing 64 is disposed between the locking wall 136 and the external surface 30 of the door 14. The body portion 70 of the bushing 64 adjacent to the recess 74 in the forward 48 direction towards the handle end 68 opposes the locking wall 136 adjacent to the locking portion 142 of the locking aperture 138. Thus, the bushing 64 resists the force 60 pulling the handle assembly 50 away from the door 14 to maintain the handle assembly 50 in the attached state 54.

As mentioned, the push-button body 116 can be manipulated via application of the force 148 into the pushed position 146 (see FIG. 8). Moving the push-button body 116 to the pushed position 146 pushes the locking portion 142 of the locking aperture 138 away from residing within the recess 74 of the bushing 64. The bushing 64 still extends through the locking aperture 138. However, the bushing 64 is free from interaction with the locking portion 142 of the locking aperture 138, and does not cooperate with the bushing 64 to keep the handle assembly 50 in the attached state 54. Instead, the unlocking portion 140 of the locking aperture 138 is disposed around the bushing 64 and clear of the bushing 64. In short, in the pushed position 146 of the push-button body 116, the locking wall 136 and the bushing 64 do not interact. The lack of interaction allows the handle assembly 50 to be detached from the bushing 64 and thus the door 14 of the oven 10. Pushing (e.g., via the force 148) the push-button body 116 to the pushed position 146 thus places the handle assembly 50 in the detachable state 56 where the force 60 pulling the handle assembly 50 can extract the handle assembly 50 from the bushing 64 and thus from the mounting stud 40 and the door 14 (as illustrated in FIG. 9). As the force 148 pushes the push-button body 116, the pair of projections 132 holding the compression springs 114 extend through a slot 152 through the spring barrier wall 150 of the standoff 78. The slot 152 is positioned to allow the pair of projections 132 to extend through the slot 152 but still allow the spring barrier wall 150 to energize the pair of compression springs 114. The other projection 134 extending from the button wall 118 cooperates with the spring barrier wall 150 to limit the extent to which the push-button body 116 can be pushed into the standoff 78 as the push-button body 116 is manipulated via the force 148. After the force 148 manipulating the push-button body 116 to or toward the pushed position 146 ends, the pair of compression springs 114 (energized while the push-button body 116 is in the pushed position 146) push the push-button body 116 back to the relaxed position 144.

When the handle assembly 50 is in the detached state 58, the handle 52 can be replaced with a new handle 52 of the user's desire (e.g., having a desired color or finish) by removing the pair of fasteners 112, removing the handle 52 from the standoff 78, adding the new handle 52 to the standoff 78, and then using the pair of fasteners 112 to fasten the new handle 52 to the standoff 78. The handle assembly 50 can be then transitioned from the detached state 58 to the attached state 54 by manipulating the push-button body 116 to the pushed position 146 via the force 148, sliding the bushing receiver 96 of the standoff 78 over the bushing 64, and then releasing the push-button body 116.

Figure 24:
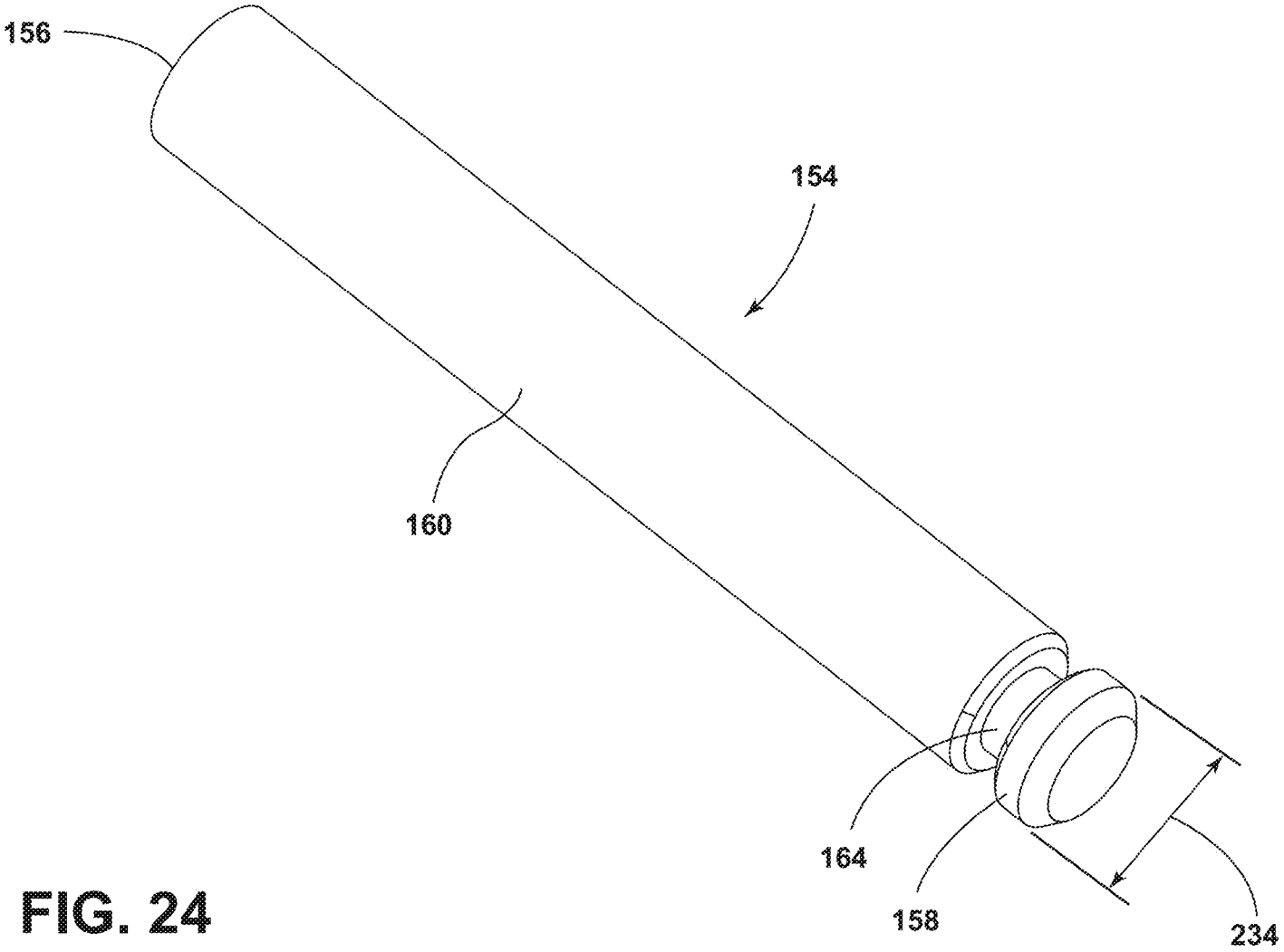
FIG. 24 is a perspective view of the anchor cylinder, illustrating the anchor cylinder including a radial groove at a handle end.
Figure 25:
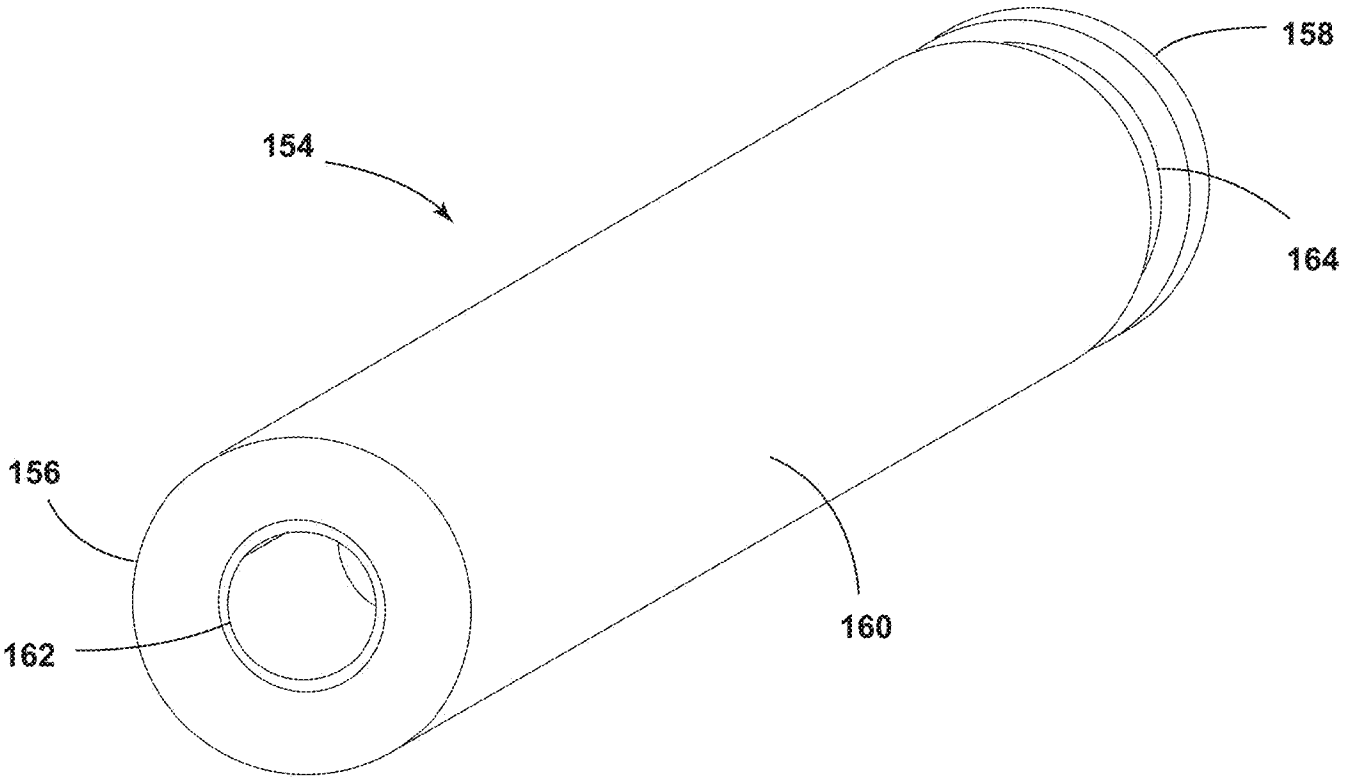
FIG. 25 is a perspective view of the anchor cylinder, illustrating a door end including an aperture to receive the mounting stud of the door.

Referring now to FIGS. 19-31, another handle assembly 50A is herein described that can be selectively attached and detached from the door 14, such as to replace a handle 52A of the handle assembly 50A. Instead of the bushing 64 of the oven 10 described above, the oven 10 includes an anchor cylinder 154 (see, e.g., FIGS. 24-25). The anchor cylinder 154 couples the handle assembly 50A to the mounting stud 40 of the door 14. The anchor cylinder 154 includes a door end 156, a handle end 158, and a body 160 that extends between the door end 156 and the handle end 158. The door end 156 has an aperture 162 and receives the mounting stud 40 to couple the handle assembly 50A to the door 14. The mounting stud 40 can be threaded to fasten the mounting stud 40 within the aperture 162 of the door end 156 of the anchor cylinder 154. The anchor cylinder 154 further includes a radial groove 164. The radial groove 164 is disposed near the handle end 158 (e.g., closer to the handle end 158 than to the door end 156).

Figure 26:
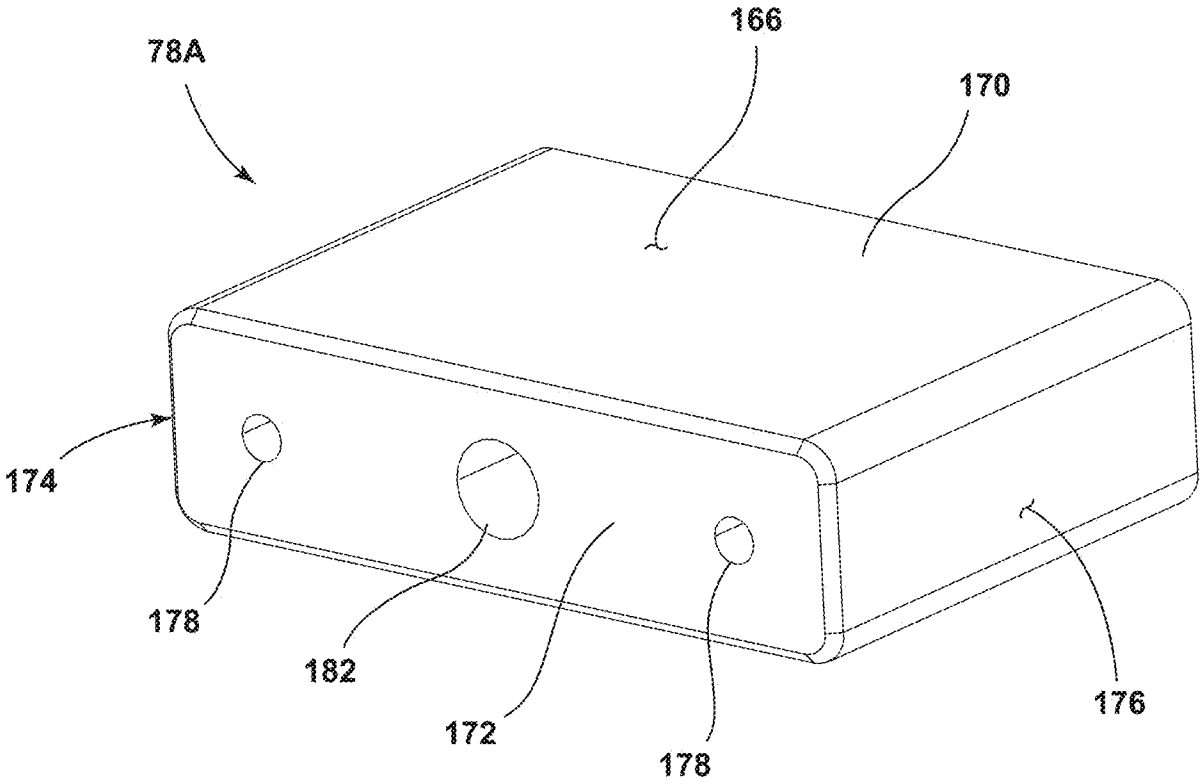
FIG. 26 is a perspective view of a standoff of the handle assembly of FIG. 19, illustrating an anchor aperture through which the anchor cylinder extends when the handle assembly is in the attached state.
Figure 27:
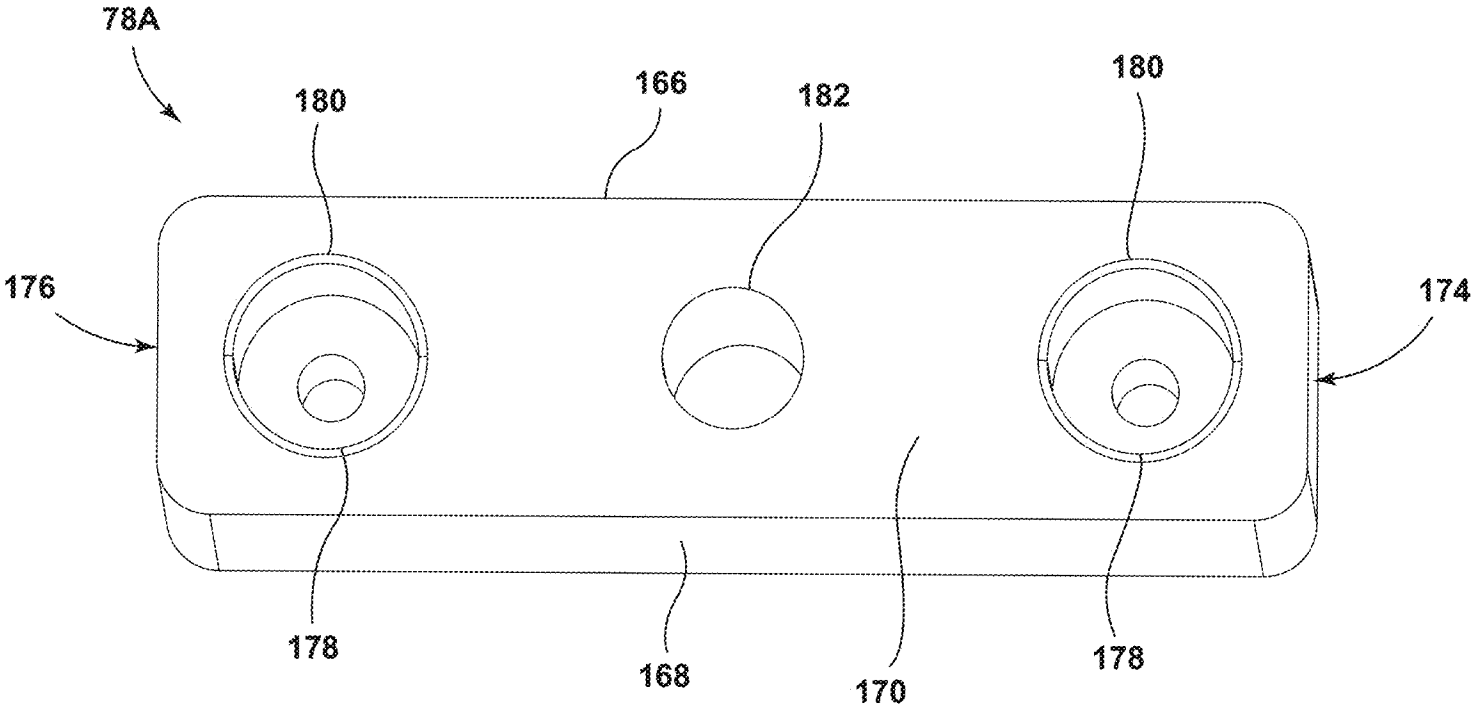
FIG. 27 is an elevation view of the standoff.

The handle assembly 50A further includes a standoff 78A (see, e.g., FIGS. 26-27). The standoff 78A includes a top surface 166, a bottom surface 168, a door edge 170, and a handle edge 172. The top surface 166 faces upwards 88 when the door 14 is in the closed position 20. The bottom surface 168 faces downwards 90 when the door 14 is in the closed position 20. The top surface 166 and the bottom surface 168 face in generally opposite directions. The door edge 170 faces the external surface 30 of the door 14. The handle edge 172 faces away from the external surface 30 of the door 14. The standoff 78A further includes a pair of lateral sides 174, 176 that face in opposite directions.

The standoff 78A further includes a pair of apertures 178. The pair of apertures 178 are disposed between the top surface 166 and the bottom surface 168, between the pair of lateral sides 174, 176, and are open at both the handle edge 172 and the door edge 170. Each of the pair of apertures 178 has a larger diameter section 180. The larger diameter sections 180 are open at the door edge 170.

The standoff 78A further includes an anchor aperture 182. The anchor aperture 182 is disposed between the top surface 166 and the bottom surface 168, between the pair of lateral sides 174, 176, and is open at both the handle edge 172 and the door edge 170. The anchor aperture 182 is sized to receive the anchor cylinder 154. The anchor aperture 182 is disposed laterally between the pair of apertures 178.

Figure 28:
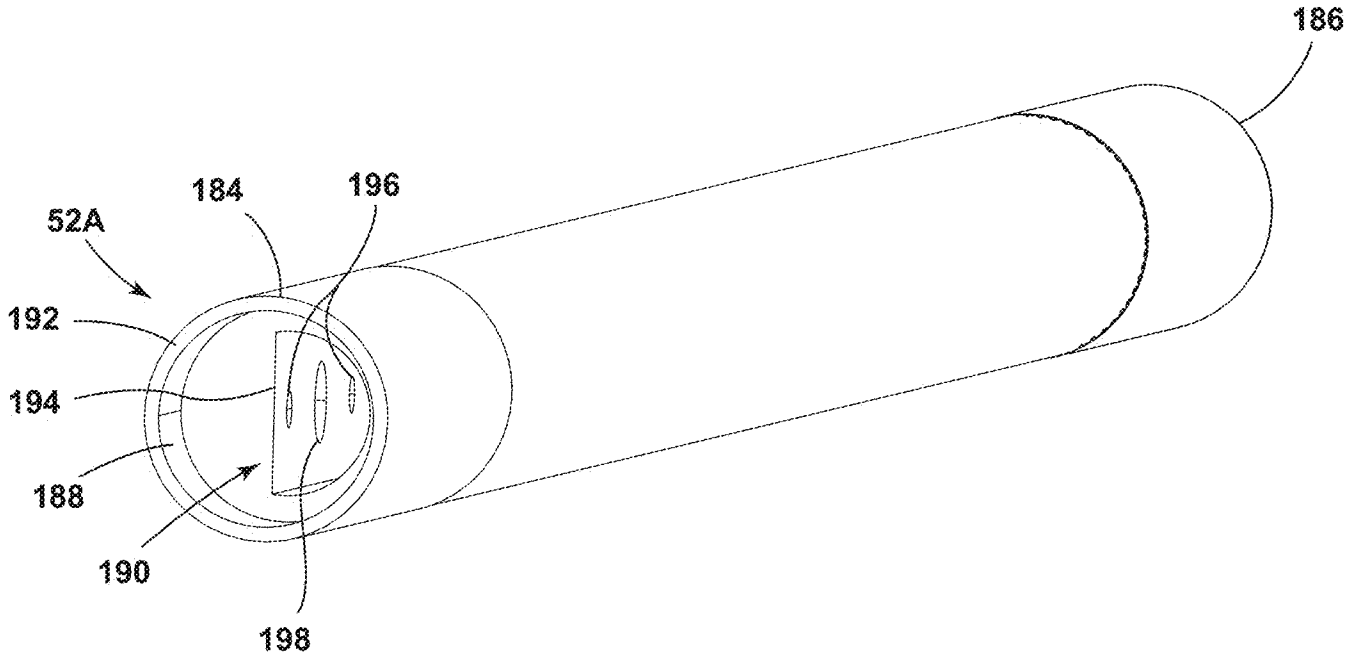
FIG. 28 is a perspective view of a handle of the handle assembly of FIG. 19, illustrating an interior chamber at a first end of the handle.
Figure 29:
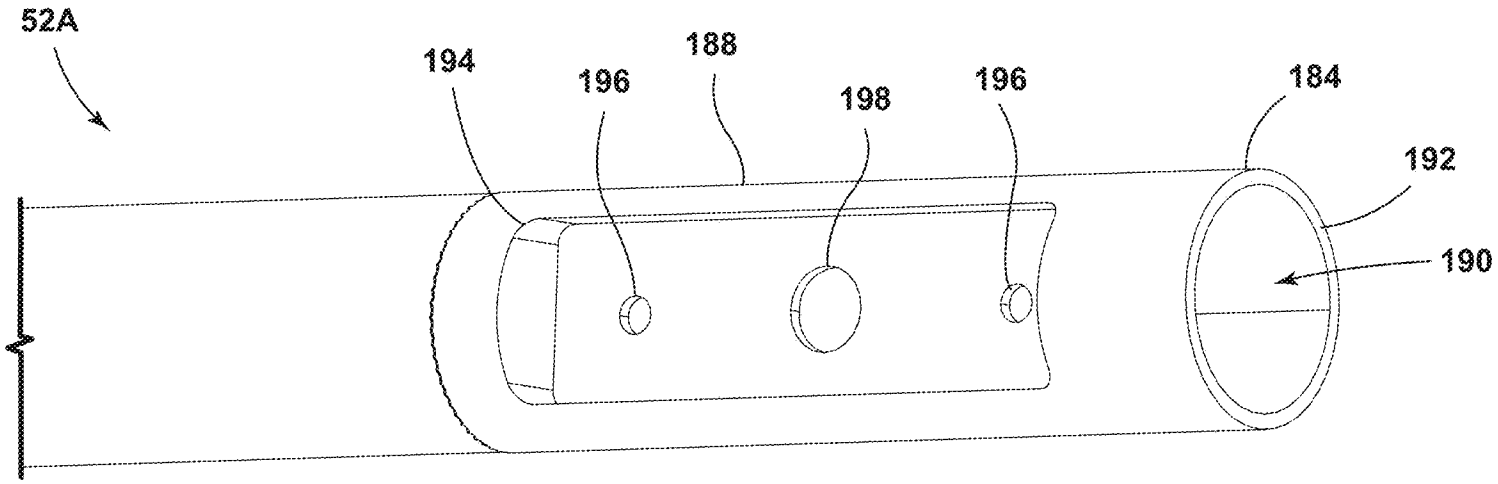
FIG. 29 is a perspective view of the first end of the handle, illustrating a recess and an anchor aperture at the recess.
Figure 30:
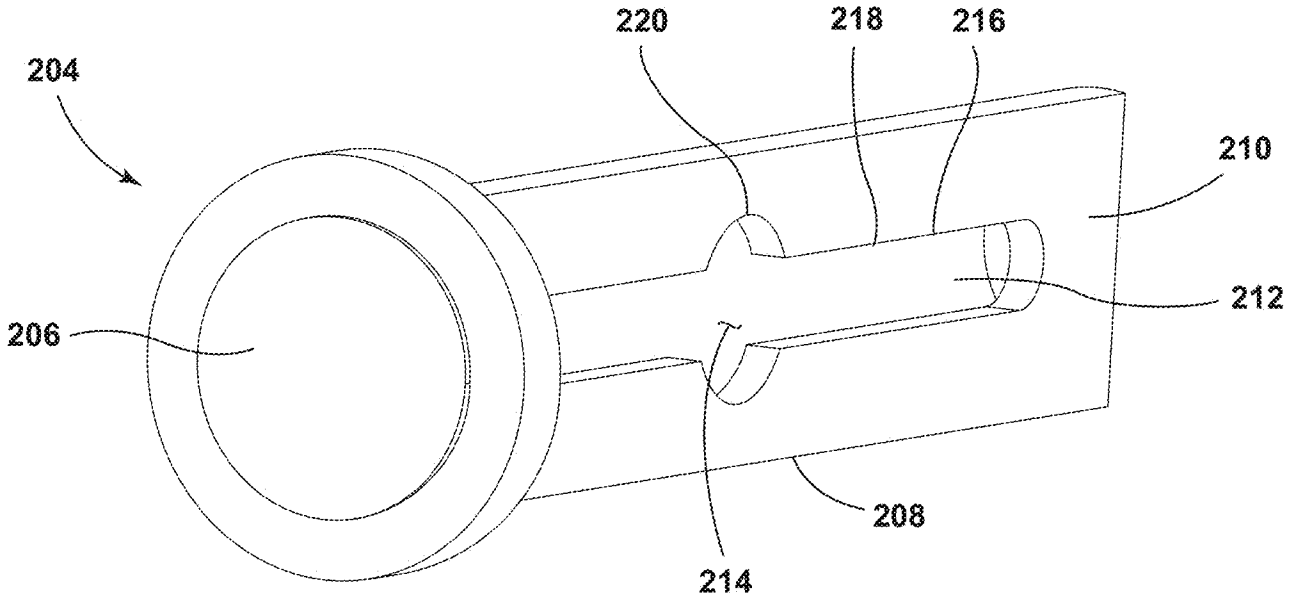
FIG. 30 is a perspective view of the push-button body of the handle assembly of FIG. 19.
Figure 31:
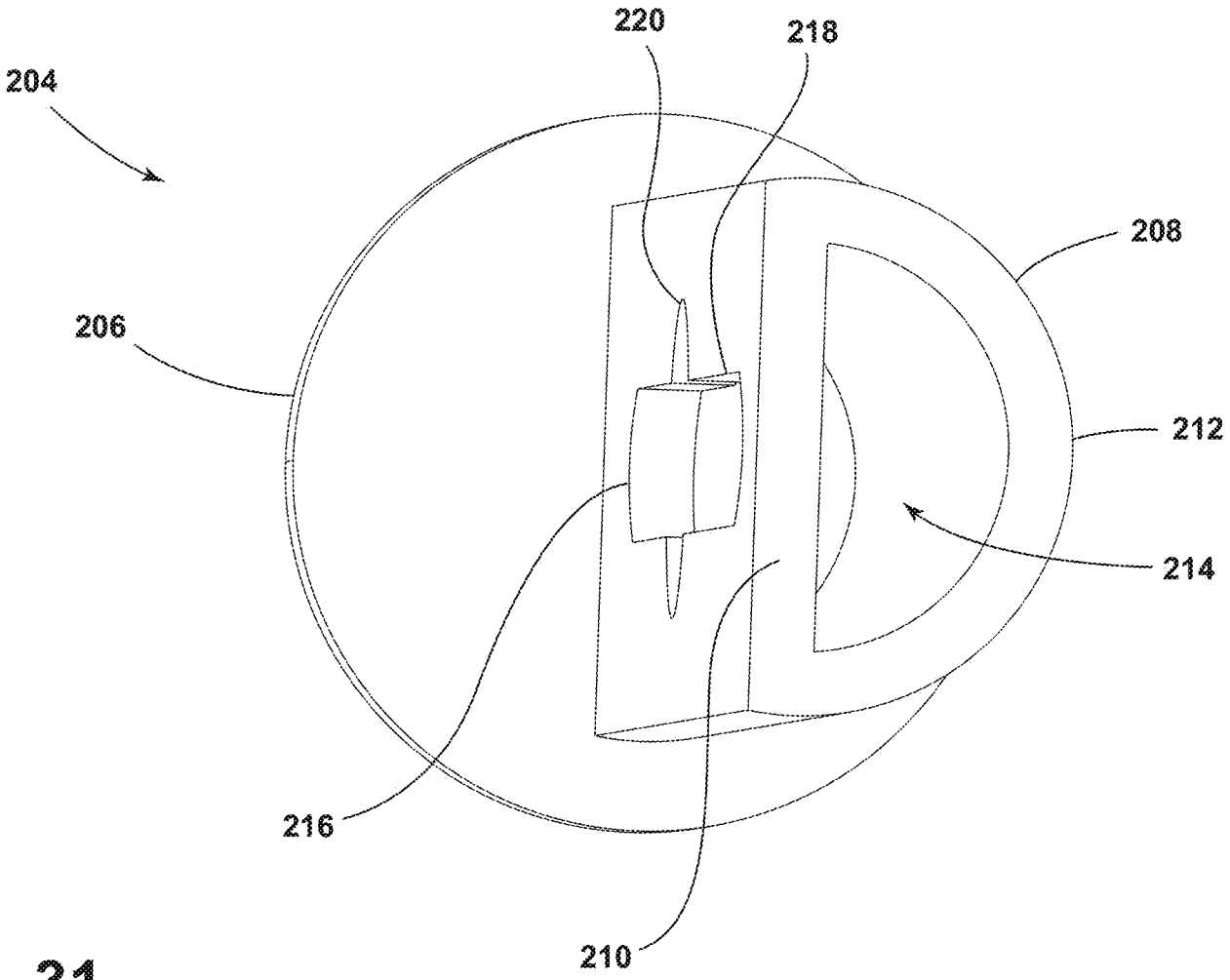
FIG. 31 is a perspective view of the push-button body of the handle assembly of FIG. 19.
Figure 32:
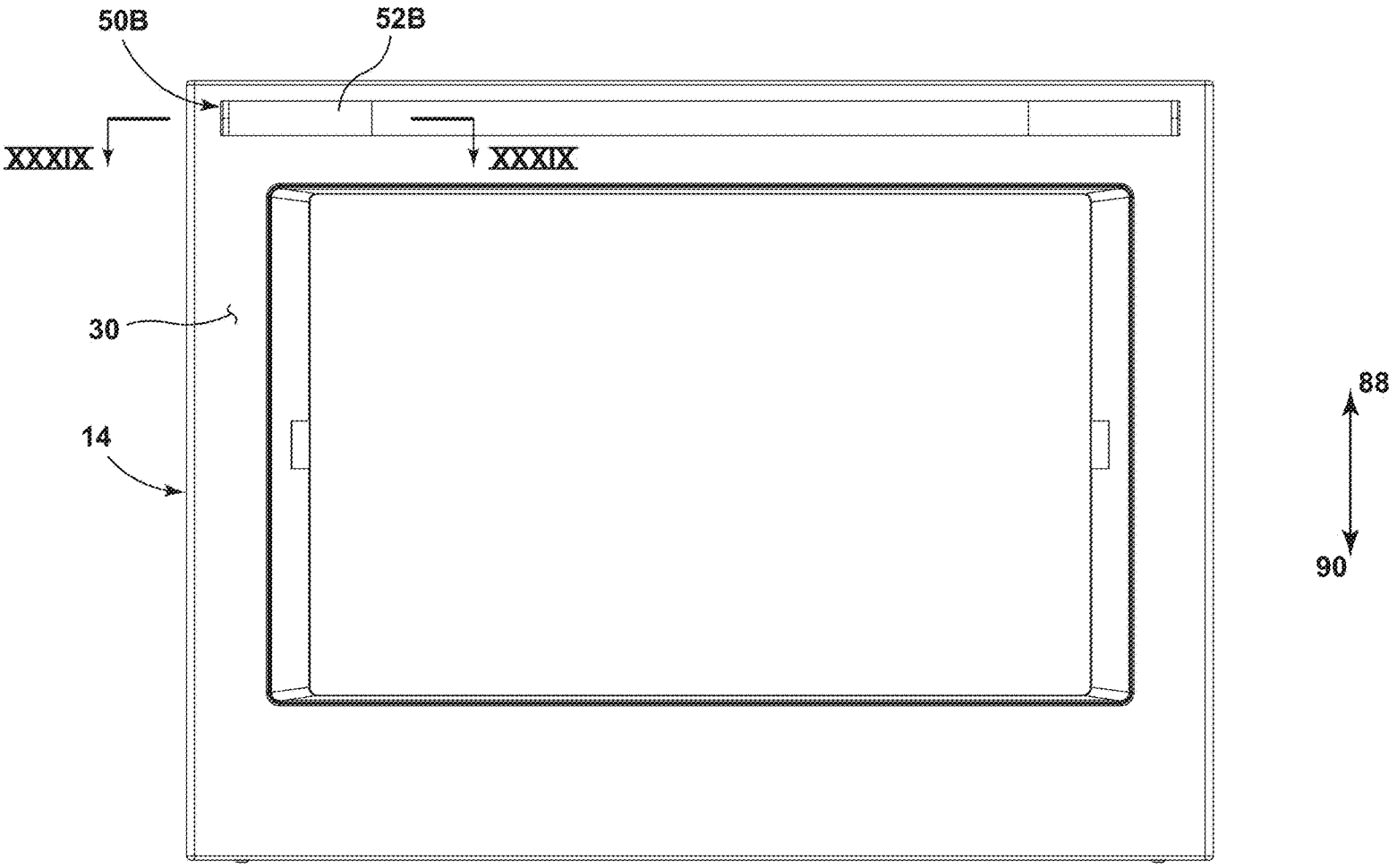
FIG. 32 is an elevation view of the door of FIG. 1 with another embodiment of a handle assembly of the present disclosure.
Figure 33:
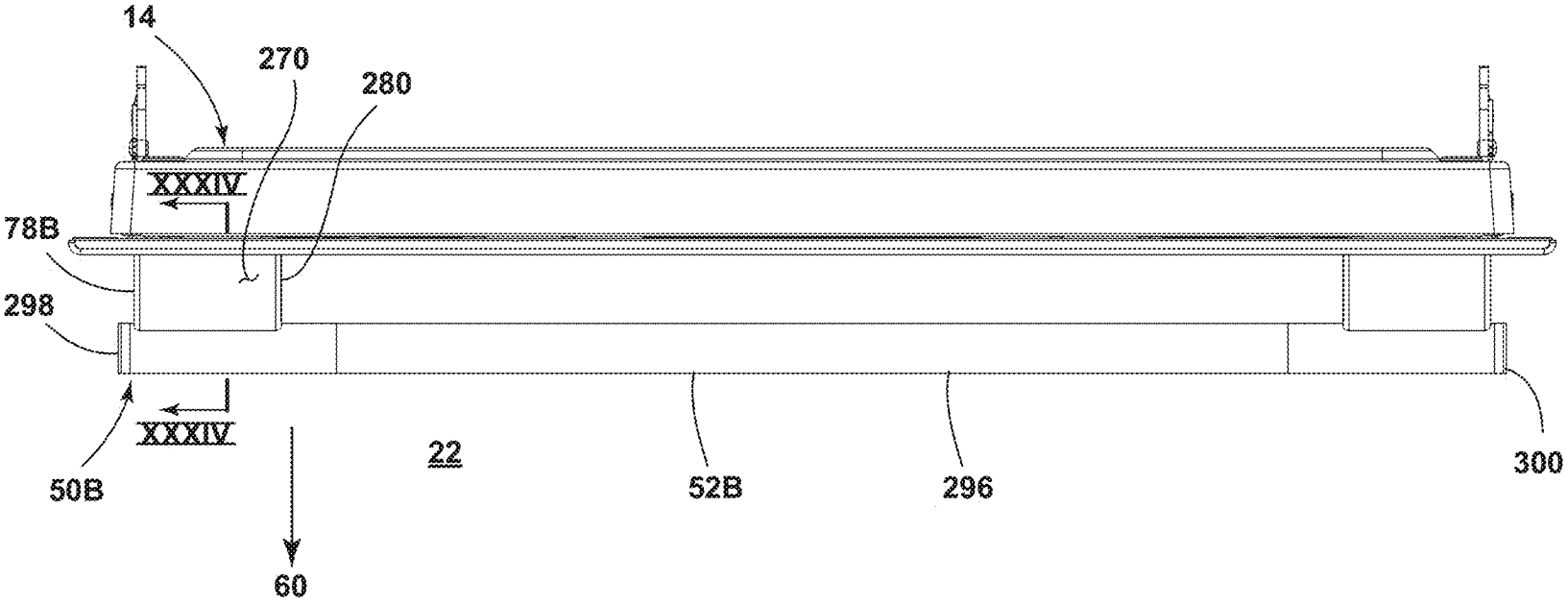
FIG. 33 is an overhead view of the door with the handle assembly of FIG. 32.
Figure 34:
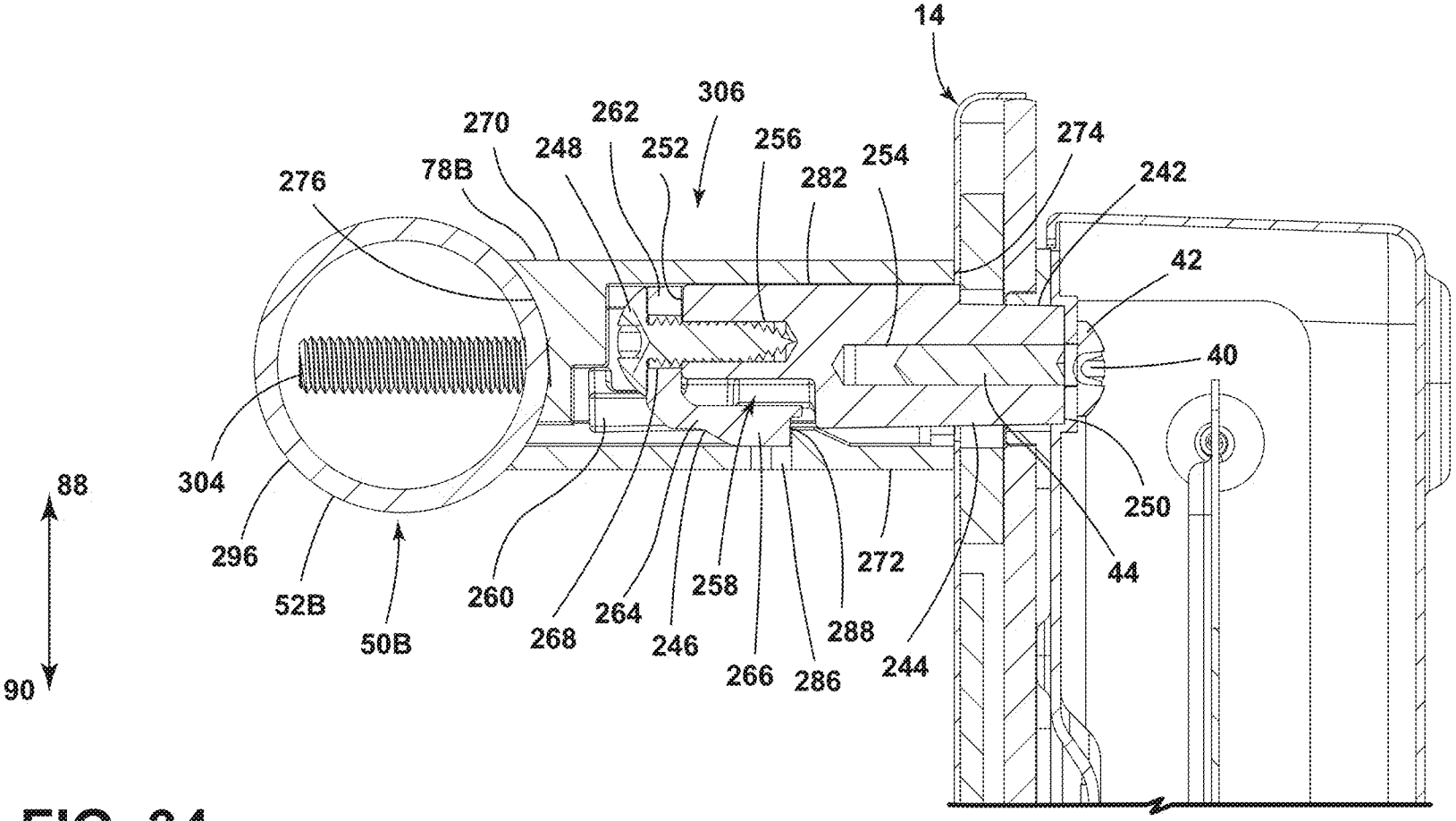
FIG. 34 is an elevation view of a cross-section taken through line XXXIV-XXXIV of FIG. 33, illustrating the handle assembly in an attached state attached to the door through the mounting stud of the door.

As mentioned, the handle assembly 50A further includes the handle 52A (see, e.g., FIGS. 28-29). The handle 52A includes a first end 184 and a second end 186. The handle 52A further includes a hollow portion 188 forming an interior chamber 190. The interior chamber 190 is disposed at the first end 184 of the handle 52A. The handle 52A further includes an opening 192 into the interior chamber 190 disposed at the first end 184. The handle 52A further includes a recess 194 at the hollow portion 188 that narrows the interior chamber 190. The handle 52A further includes a pair of apertures 196 and an anchor aperture 198 disposed between the pair of apertures 196.

The handle assembly 50A further includes a push-button mechanism 200. The push-button mechanism 200 includes a compression spring 202 and a push-button body 204.

The push-button body 204 includes a button 206 and a hollow semi-cylinder 208 extending from the button 206. The hollow semi-cylinder 208 includes a planar wall 210, a semi-cylindrical wall 212 contiguous with the planar wall 210, and an internal chamber 214. The planar wall 210 and the semi-cylindrical wall 212 at least partially bound the internal chamber 214. The push-button body 204 further includes an anchor aperture 216. The anchor aperture 216 is through the planar wall 210. The anchor aperture 216 includes a locking section 218 and an unlocking section 220. The unlocking section 220 is larger than the locking section 218. For example, both the locking section 218 and the unlocking section 220 can have a height 222, 224, respectively. The height 222 of the locking section 218 is shorter than the height 224 of the unlocking section 220. The button 206 can display a logo that is visible from the external environment 22.

The push-button mechanism 200 is disposed within the interior chamber 190 of the handle 52A. The hollow semi-cylinder 208 of the push-button body 204 is disposed further within the interior chamber 190 than the button 206. The hollow semi-cylinder 208 extends inward into the internal chamber 214 from the button 206. The button 206 of the push-button body 204 is manipulable at the opening 192 of the handle 52A. The button 206 is open to the external environment 22 and accessible at the opening 192. The planar wall 210 of the hollow semi-cylinder 208 faces the recess 194 of the handle 52A. The compression spring 202 is disposed between the button 206 and the recess 194 of the handle 52A at the first end 184.

The handle edge 172 of the standoff 78A faces the handle 52A and is disposed within the recess 194 of the handle 52A near the first end 184 of the handle 52A. A pair of fasteners 226 extend into the pair of apertures 178 of the standoff 78A, through the pair of apertures 196 of the handle 52A to enter the interior chamber 190 of the handle 52A, and into the anchor aperture 216 of the hollow semi-cylinder 208 of the push-button body 204 to terminate within the internal chamber 214 of the push-button body 204. The pair of fasteners 226 thus fasten the handle 52A and the standoff 78A together. The pair of fasteners 226 each have a head 228 that is disposed within the larger diameter section 180 of their respective aperture 178 of the standoff 78A.

Figure 23:
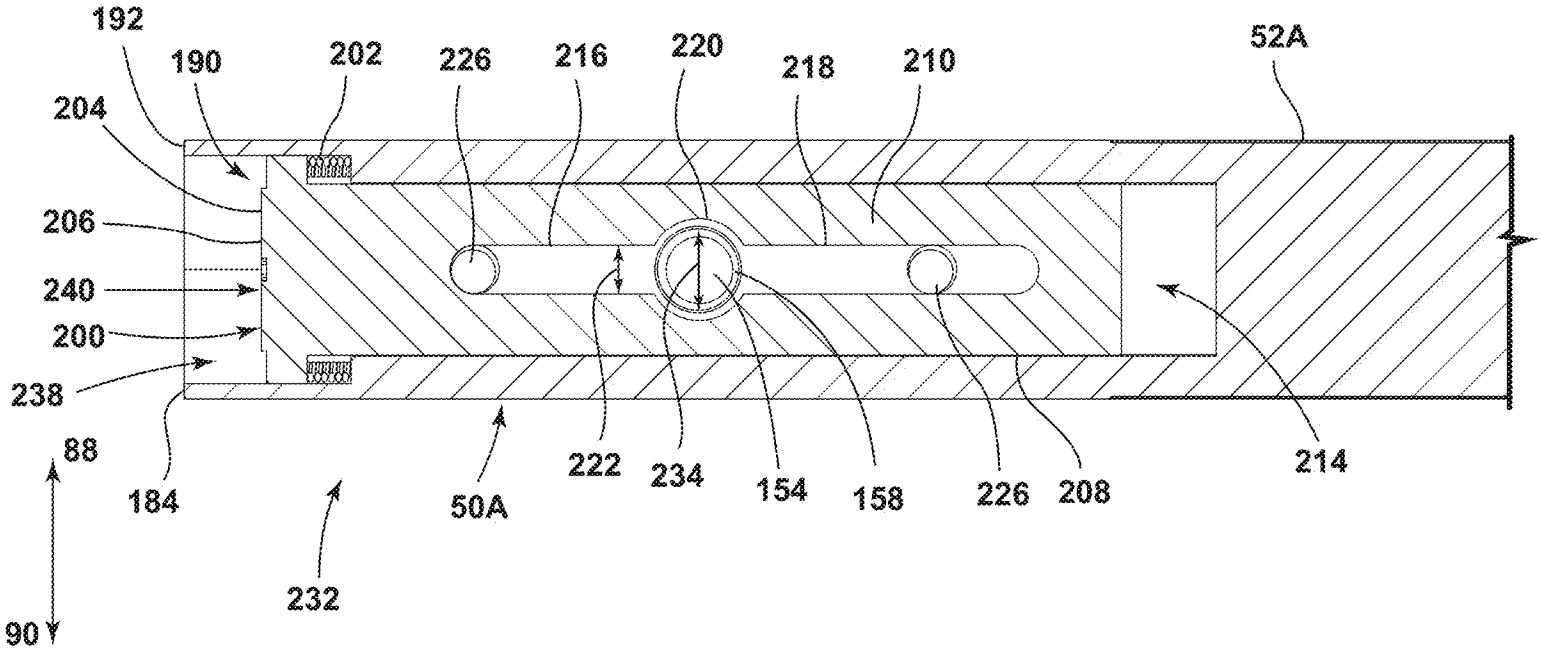
FIG. 23 is the same view as FIG. 22, but this time showing the push-button body in a pushed position where an unlocking section of the anchor aperture of the push-button body does not cooperate with the anchor aperture thus placing the handle assembly in a detachable state.

The handle assembly 50A includes and can be manipulated to, from, and between an attached state 230 (see FIGS. 21 and 22) and a detachable state 232 (see FIG. 23). In the attached state 230, the handle assembly 50A is attached to the door 14 through coupling with the mounting stud 40 via the anchor cylinder 154. As mentioned, the door end 156 of the anchor cylinder 154 is fastened to the mounting stud 40. The body 160 of the anchor cylinder 154 projects through the anchor aperture 182 of the standoff 78A, through the anchor aperture 198 of the handle 52A at the first end 184, and then through the anchor aperture 216 of the push-button body 204. The handle end 158 of the anchor cylinder 154 terminates within the interior chamber 190 of the handle 52A and more specifically the internal chamber 214 of the push-button body 204. The radial groove 164 of the anchor cylinder 154 is positioned to interact with the planar wall 210 of the push-button body 204 at the anchor aperture 216. The handle end 158 of the anchor cylinder 154 has a diameter 234 that is larger than the height 222 of the locking section 218 of the anchor aperture 216 of the push-button body 204 but smaller than the height 224 of the unlocking section 220 of the anchor aperture 216. The radial groove 164 of the anchor cylinder 154 extends through the locking section 218 of the anchor aperture 216. The planar wall 210 adjacent to the locking section 218 is disposed between the handle end 158 of the anchor cylinder 154 and the external surface 30 of the door 14. The interaction between the planar wall 210 and the handle end 158 of the anchor cylinder 154 thus secures the handle assembly 50A in the attached state 230 attached to the door 14. In the attached state 230, the standoff 78A is disposed between the handle 52A and the external surface 30 of the door 14. The planar wall 210 of the hollow semi-cylinder 208 of the push-button body 204 faces the door 14.

The push-button body 204 has and can move to, from, and between a relaxed position 236 (see FIGS. 21 and 22) and a pushed position 238 (see FIG. 23). In the relaxed position 236, the push-button body 204 is not being manipulated by a force 240 from the external environment 22. The button 206 is sized and position to be flush with the opening 192 of the handle 52A when the push-button body 204 is in the relaxed position 236. In the pushed position 238, the force 240 upon the button 206 manipulates the push-button body 204 further into the internal chamber 214 of the handle 52A. The compression spring 202 of the push-button mechanism 200 energizes when the force 240 manipulates the push-button body 204 to the pushed position 238. The compression spring 202 thus biases the push-button body 204 back to the relaxed position 236 when the force 240 ceases.

Manipulating the push-button body 204 to the pushed position 238 transitions the handle assembly 50A from the attached state 230 to the detachable state 232 where the handle assembly 50A can be removed from the door 14 by decoupling from the anchor cylinder 154. In the pushed position 238, the radial groove 164 of the anchor cylinder 154 extends through the unlocking section 220 of the anchor aperture 216 of the push-button body 204. The planar wall 210 of the push-button body 204 adjacent to the unlocking section 220 and the handle end 158 of the anchor cylinder 154 do not interact. The handle assembly 50A is thus in the detachable state 232 and can be withdrawn from the door 14 leaving the anchor cylinder 154 attached to the mounting stud 40. The user can then replace the handle 52A if desired.

Thereafter, the user can reattach the handle assembly 50A to the door 14 by reversing the above described process.

Referring now to FIGS. 32-41, another handle assembly 50B is herein described that can be selectively attached and detached from the mounting stud 40 of the door 14 of the oven 10. The handle assembly 50B is utilized with a bushing 242 to couple the handle assembly 50B to the mounting stud 40 of the door 14. The bushing 242 (see, e.g., FIGS. 36-38) includes a body 244, a snap-fit piece 246 attached to the body 244, and a bushing fastener 248 that fastens the snap-fit piece 246 to the body 244. The body 244 includes a door end 250 and a handle end 252. The door end 250 includes an aperture 254 that extends toward the handle end 252. The aperture 254 receives the mounting stud 40 to fasten the bushing 242 to the door 14. The handle end 252 includes an aperture 256 that extends toward the door end 250. The bushing 242 further includes a recess 258 into the body 244. The recess 258 is disposed into the body 244 between the door end 250 and the handle end 252. The bushing 242 further includes a pair of spaced apart fingers 260. The pair of spaced apart fingers 260 extend from the handle end 252 and away from the external surface 30 of the door 14.

The snap-fit piece 246 includes an O-shaped section 262, a flexural element 264, and a retaining feature 266. The O-shaped section 262 is disposed against the handle end 252 of the body 244. The O-shaped section 262 has a central aperture 268. The central aperture 268 is aligned with the aperture 256 of the handle end 252 to receive the bushing fastener 248. A bushing fastener 248 extends through both the central aperture 268 of the snap-fit piece 246 and the aperture 256 of the body 244 to fasten the snap-fit piece 246 to the body 244. The flexural element 264 extends from the O-shaped section 262 between the spaced apart fingers 260 of the body 244 and then substantially orthogonally relative to the O-shaped section 262 to terminate within or adjacent to the recess 258 that is in the body 244. The flexural element 264 terminates in the retaining feature 266.

Figure 40:
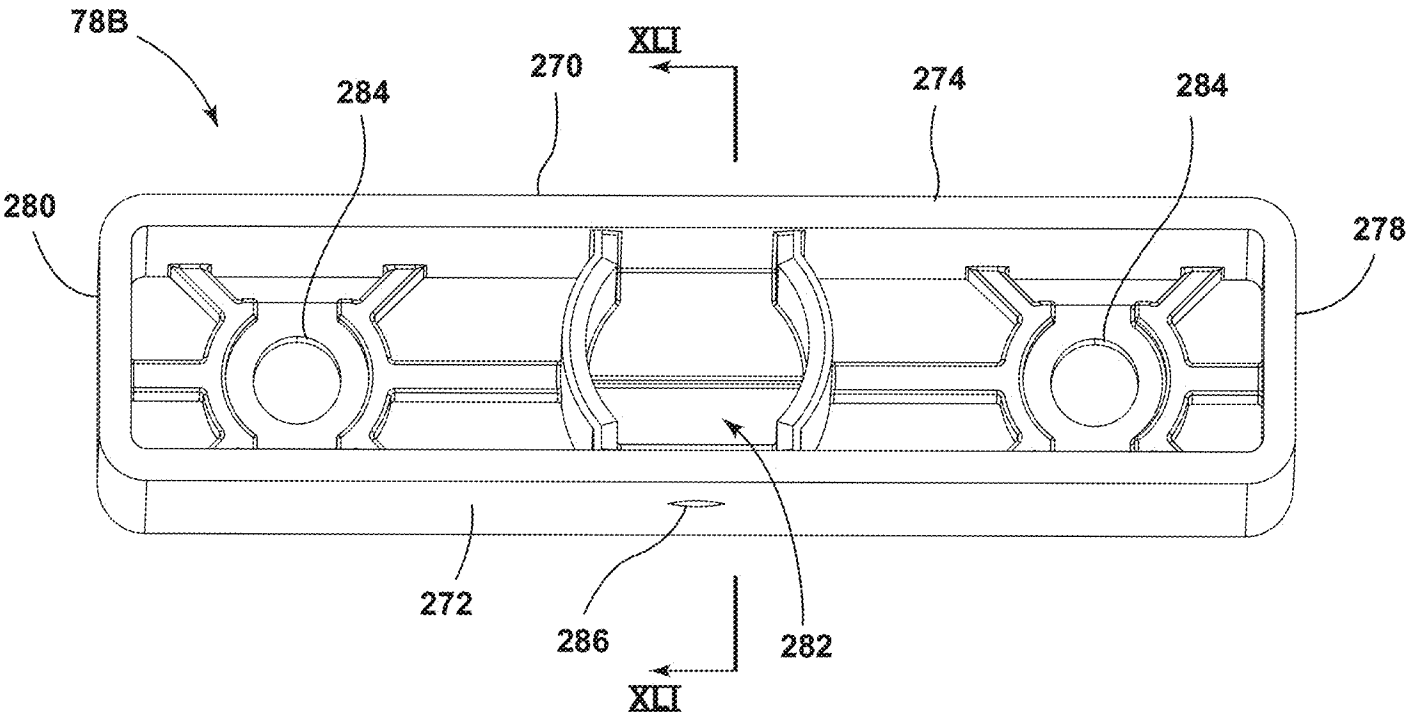
FIG. 40 is a perspective view of a standoff of the handle assembly of FIG. 32, illustrating a bushing receiver.
Figure 41:
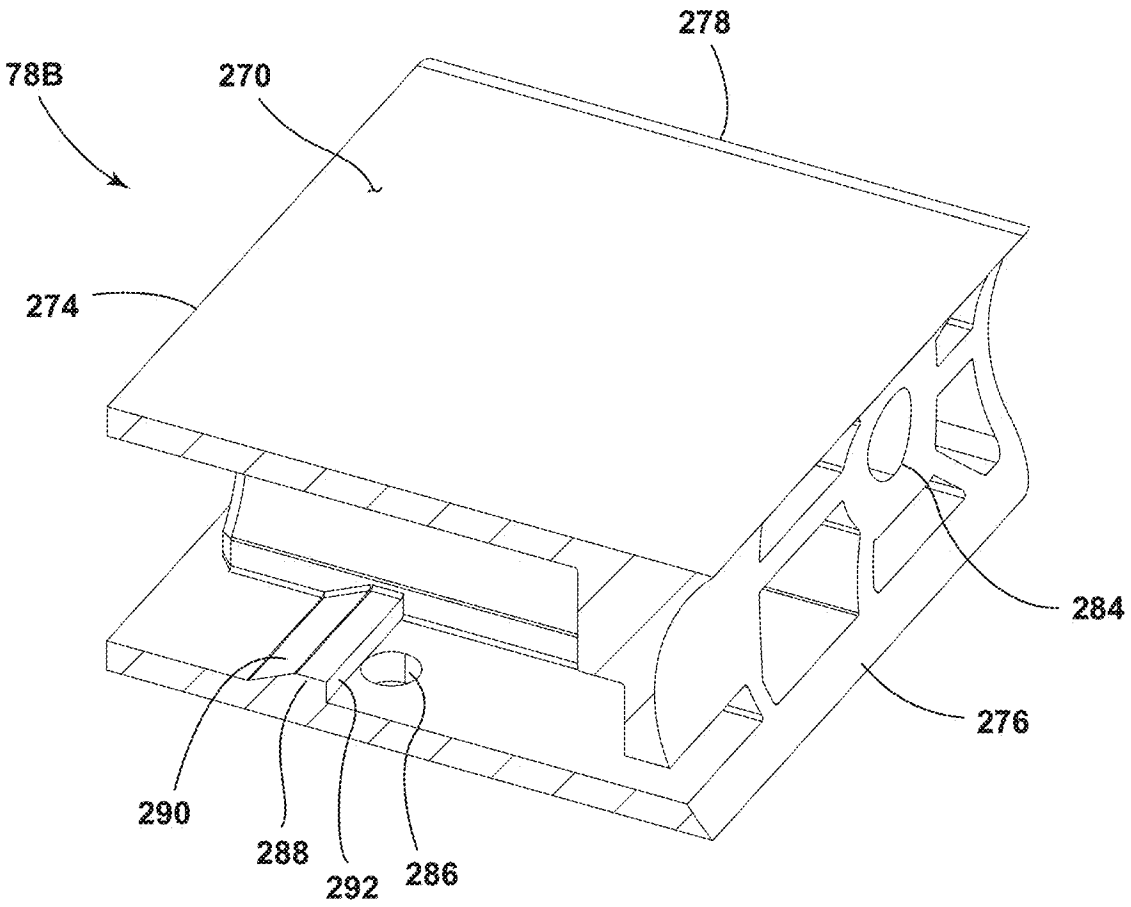
FIG. 41 is a perspective view of a cross-section of the standoff taken through line XLI-XLI of FIG. 40.

The handle assembly 50B includes a standoff 78B (see, e.g., FIGS. 40-41). The standoff 78B includes a top surface 270 and a bottom surface 272. The top surface 270 faces upwards 88 when the door 14 is in the closed position 20. The bottom surface 272 faces downwards 90 when the door 14 is in the closed position 20. The standoff 78B further includes a door edge 274, and a handle edge 276. The standoff 78B further includes two lateral sides 278, 280 that face in opposite directions.

The standoff 78B further includes a bushing receiver 282. The bushing receiver 282 is disposed between the top surface 270 and the bottom surface 272, and between the two lateral sides 278, 280. The bushing receiver 282 is open at the door edge 274 and extends toward the handle edge 276.

The standoff 78B further includes a pair of fastener apertures 284. The pair of fastener apertures 284 are disposed between the top surface 270 and the bottom surface 272, and between the two lateral sides 278, 280. The fastener apertures are open at the handle edge 276.

The standoff 78B further includes an aperture 286 into the bushing receiver 282. The aperture 286 is accessible from the external environment 22. For example, the aperture 286 of the illustrated embodiment is disposed through the bottom surface 272 of standoff 78B and opens into the bushing receiver 282. The standoff 78B further includes a retaining feature 288. The retaining feature 288 is disposed within the bushing receiver 282. The retaining feature 288 includes a sloped portion 290 and a vertical portion 292. The vertical portion 292 is disposed adjacent to the aperture 286.

The handle assembly 50B includes a handle 52B. The handle 52B includes a hollow cylinder 296, a first end 298, and a second end 300. The handle 52B further includes a pair of apertures 302 through the hollow cylinder 296. The pair of apertures 302 are disposed near the first end 298 of the handle 52B (e.g., closer to the first end 298 than to the second end 300). Each of the pair of apertures 302 of the handle 52B is aligned with a different one of the pair of fastener apertures 284 of the standoff 78B.

The handle assembly 50B further includes a pair of fasteners 304. The pair of fasteners 304 extend through the pair of fastener apertures 284 of the standoff 78B and through the pair of apertures 302 of the handle 52B to fasten the standoff 78B and the handle 52B together. The handle edge 276 of the standoff 78B faces the handle 52B.

Figure 35:
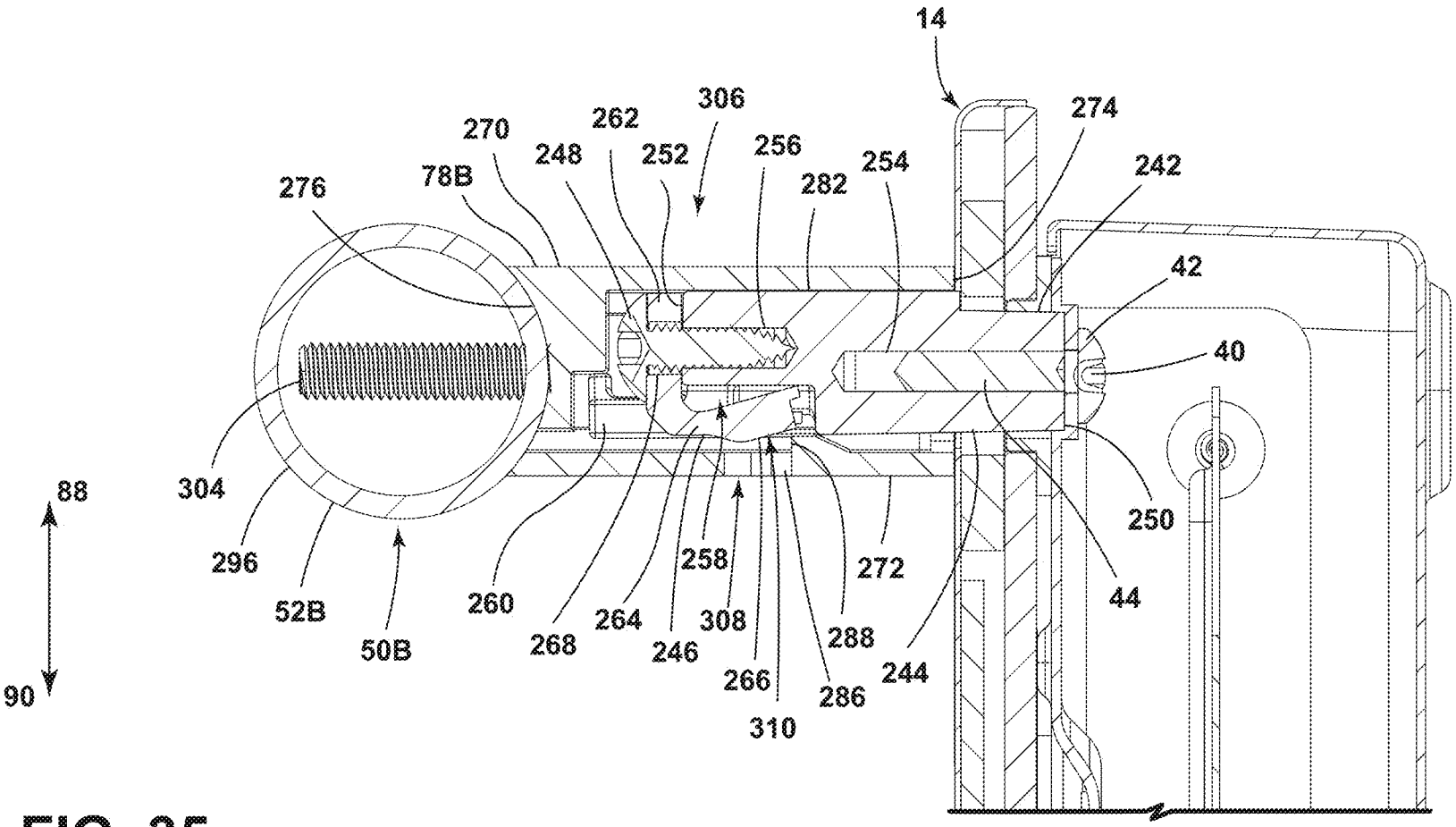
FIG. 35 is the same view as FIG. 34 but this time showing the handle assembly being manipulated to a detachable state.
Figure 36:
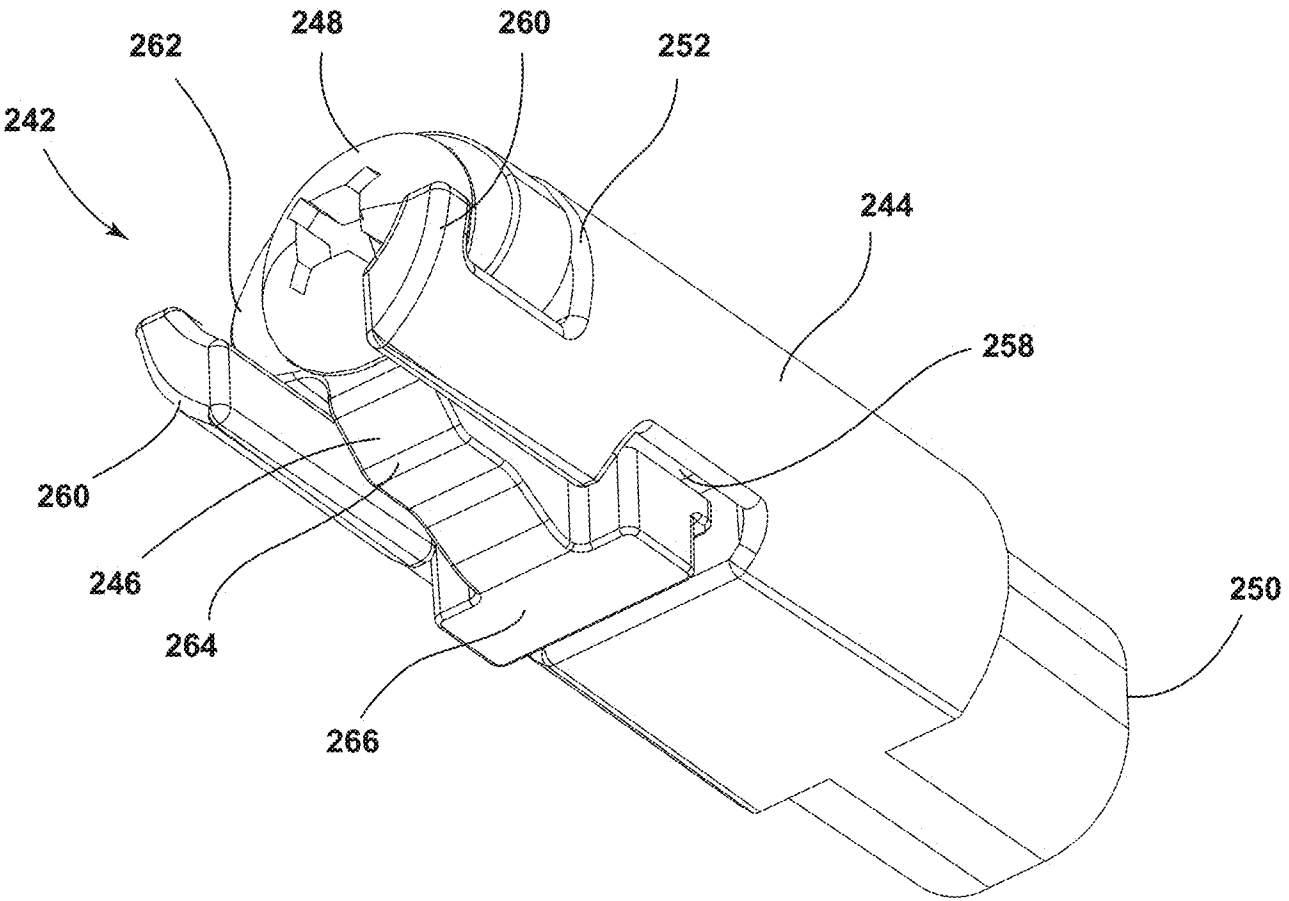
FIG. 36 is a perspective view of a bushing of the handle assembly of FIG. 32, illustrating the bushing including a snap-fit piece.
Figure 37:
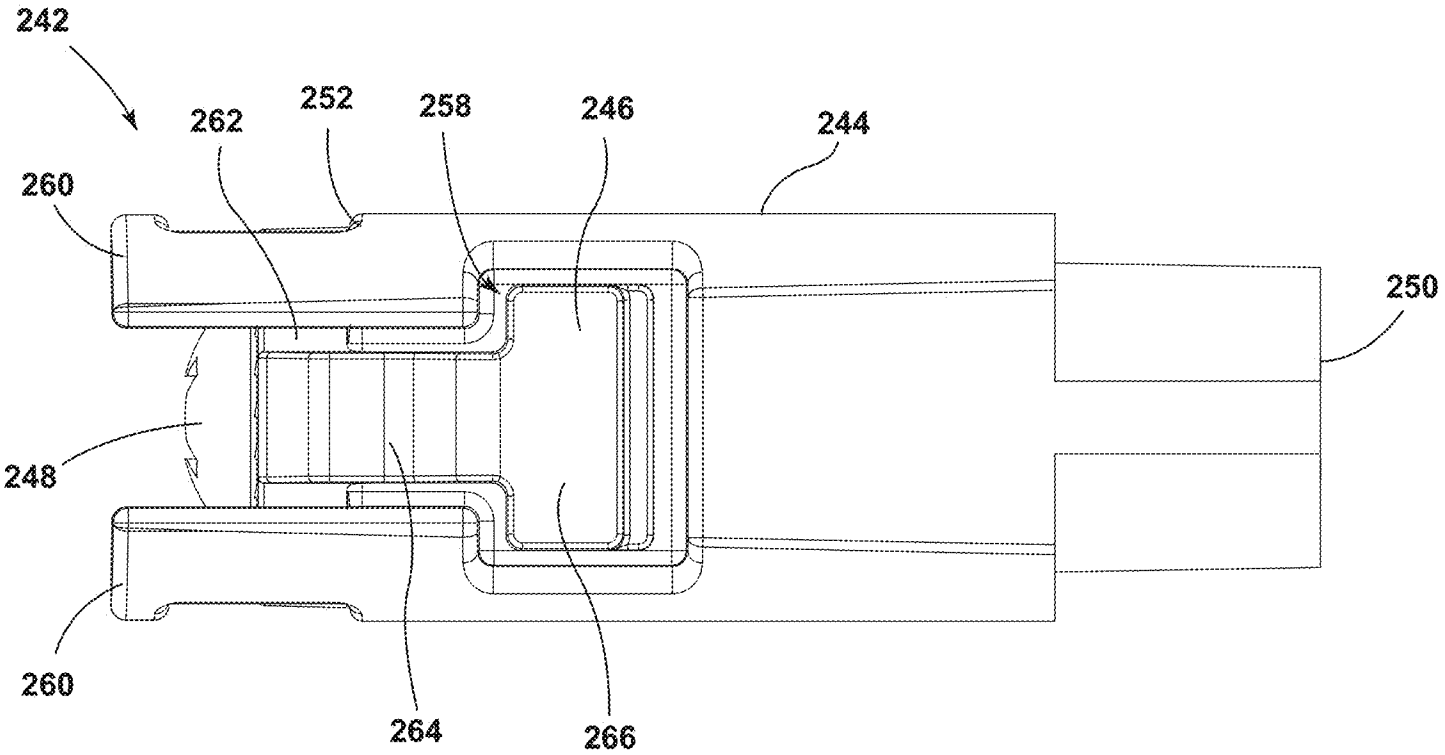
FIG. 37 is a bottom view of the bushing, illustrating the snap-fit piece including a flexural element extending through two spaced apart fingers of a body of the bushing.
Figure 38:
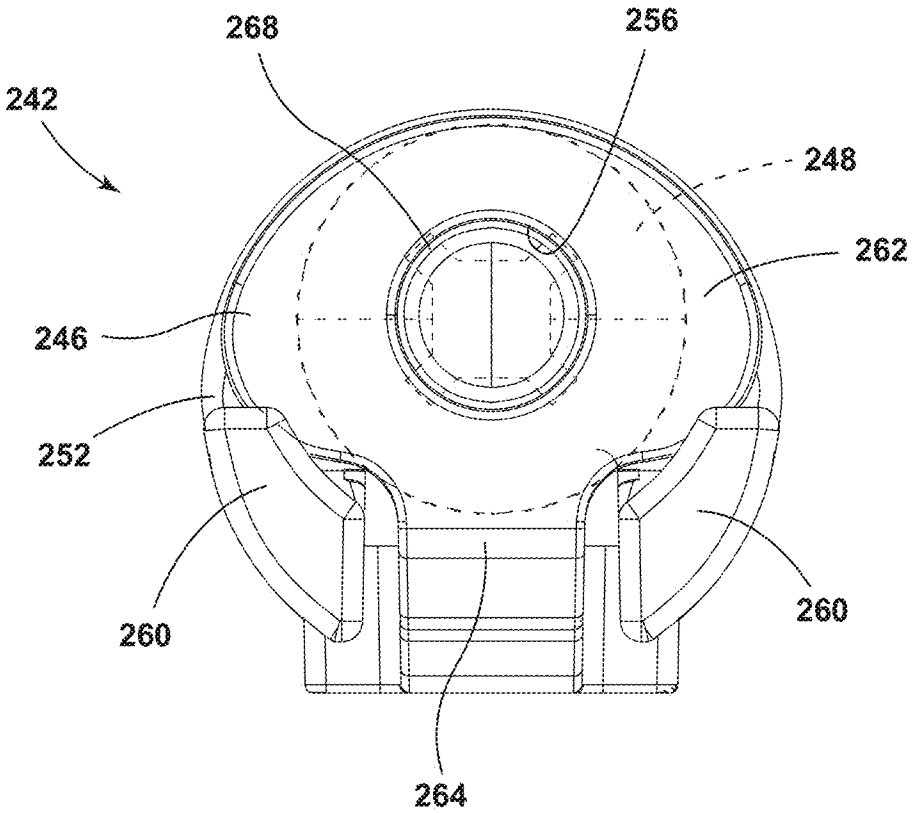
FIG. 38 is an elevation view of the bushing.
Figure 39:
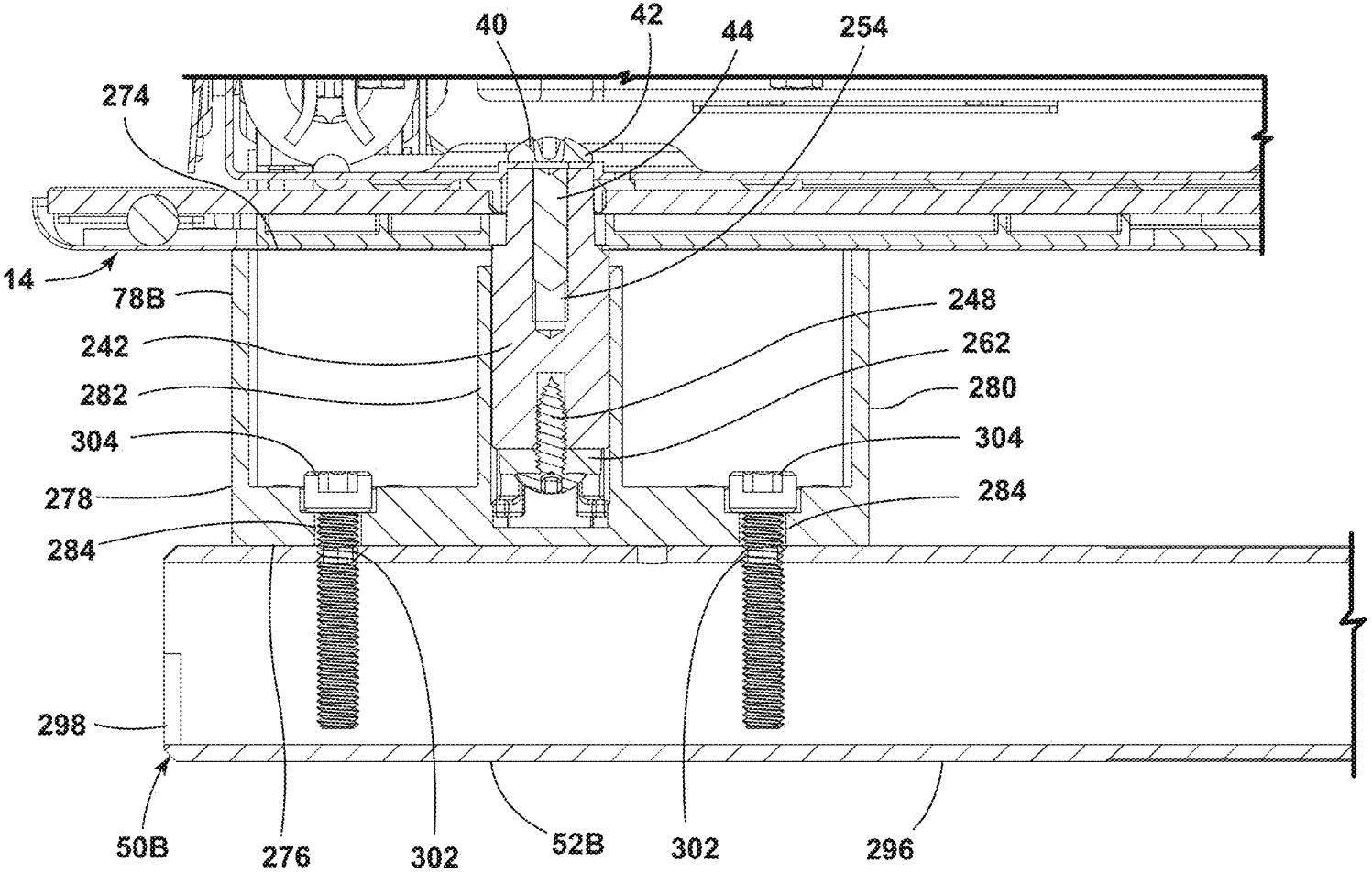
FIG. 39 is an overhead view of a cross-section taken through line XXXIX-XXXIX of FIG. 32.

The handle assembly 50B includes, and can move to, from, and between an attached state 306 (see, e.g., FIG. 34) and a detachable state 308 (see, e.g., FIG. 35). In the attached state 306, the handle assembly 50B is attached to the door 14 through coupling with the mounting stud 40. More specifically, the body 244 of the bushing 242 is at least partially disposed within the bushing receiver 282 of the standoff 78B. The handle end 252 of the body 244 of the bushing 242 is disposed within the bushing receiver 282 while the door end 250 of the body 244 may not be. The retaining feature 288 of the standoff 78B cooperates with the retaining feature 266 of the snap-fit piece 246 of the bushing 242 to couple the handle assembly 50B to the bushing 242 and place the handle assembly 50B in the attached state 306. More specifically, the retaining feature 266 of the snap-fit piece 246 of the bushing 242 faces the vertical portion 292 of the retaining feature 288 of the standoff 78B when the handle assembly 50B is in the attached state 306 and thus resists the force 60 pulling the handle 52B away from the external surface 30 of the door 14. The standoff 78B is disposed between the external surface 30 of the door 14 and the handle 52B. The door edge 274 of the standoff 78B faces the door 14.

To transition the handle assembly 50B to the detachable state 308 where the handle assembly 50B is separable from the bushing 242 and thus from the door 14, the retaining feature 266 of the snap-fit piece 246 of the bushing 242 is manipulated (see FIG. 35). The retaining feature 266 is manipulated from the external environment 22 through the aperture 286 through the standoff 78B. For example, a force 310 upon the retaining feature 266 of the snap-fit piece 246 causes the flexural element 264 to flex and the retaining feature 266 moves further into the recess 258 of the body 244 of the bushing 242. The retaining feature 266 of the snap-fit piece 246 no longer opposes the vertical portion 292 of the retaining element of the standoff 78B and thus is decoupled therefrom. The force 60 pulling the handle 52B away from the door 14 can thus remove the handle assembly 50B. The bushing 242 remains attached to the mounting stud 40 of the door 14 while the bushing 242 slides out of the bushing receiver 282 of the standoff 78B of the handle assembly 50B. The user can then replace the handle 52B as desired.

To reposition the handle assembly 50B in the attached state 306, the user places the bushing 242 within the bushing receiver 282 and moves the handle assembly 50B closer to the external surface 30 of the door 14. As the retaining feature 288 of the standoff 78B begins to interact with the snap-fit piece 246 of the bushing 242, the sloped portion 290 of the retaining feature 288 of the standoff 78B causes the flexural element 264 to flex and the retaining feature 266 of the snap-fit piece 246 moves further into the recess 258 of the body 244 of the bushing 242. As the handle assembly 50B moves closer to the external surface 30 of the door 14, the retaining feature 266 of the snap-fit piece 246 clears the retaining feature 288 of the standoff 78B, and the flexural element 264 causes the retaining feature 288 to snap into position opposing the vertical portion 292 of the retaining element of the standoff 78B. The handle assembly 50B is thus again in the attached state 306.

Figure 42:
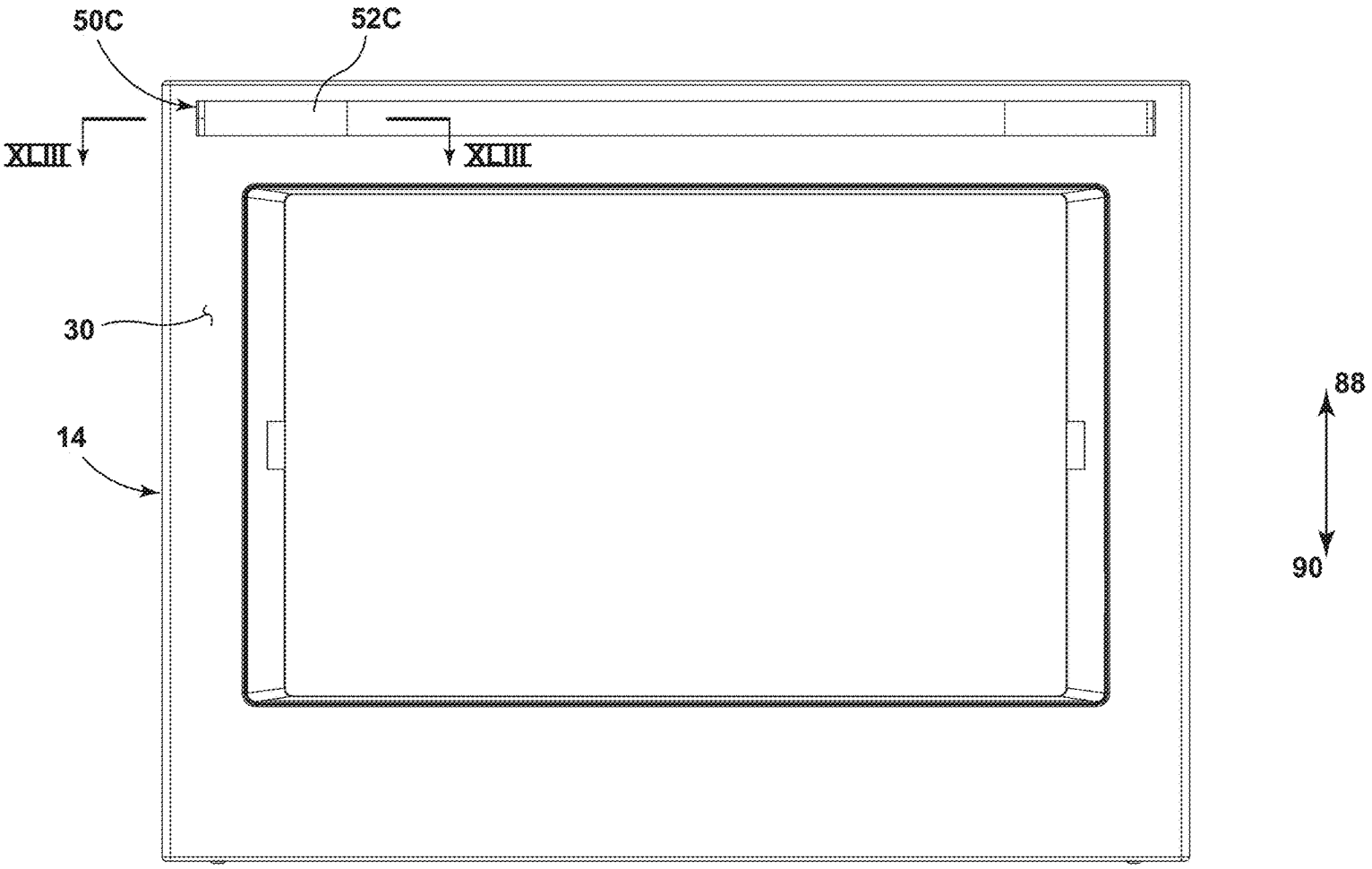
FIG. 42 is an elevation view of the door of FIG. 1 with another embodiment of a handle assembly of the present disclosure.
Figure 43:
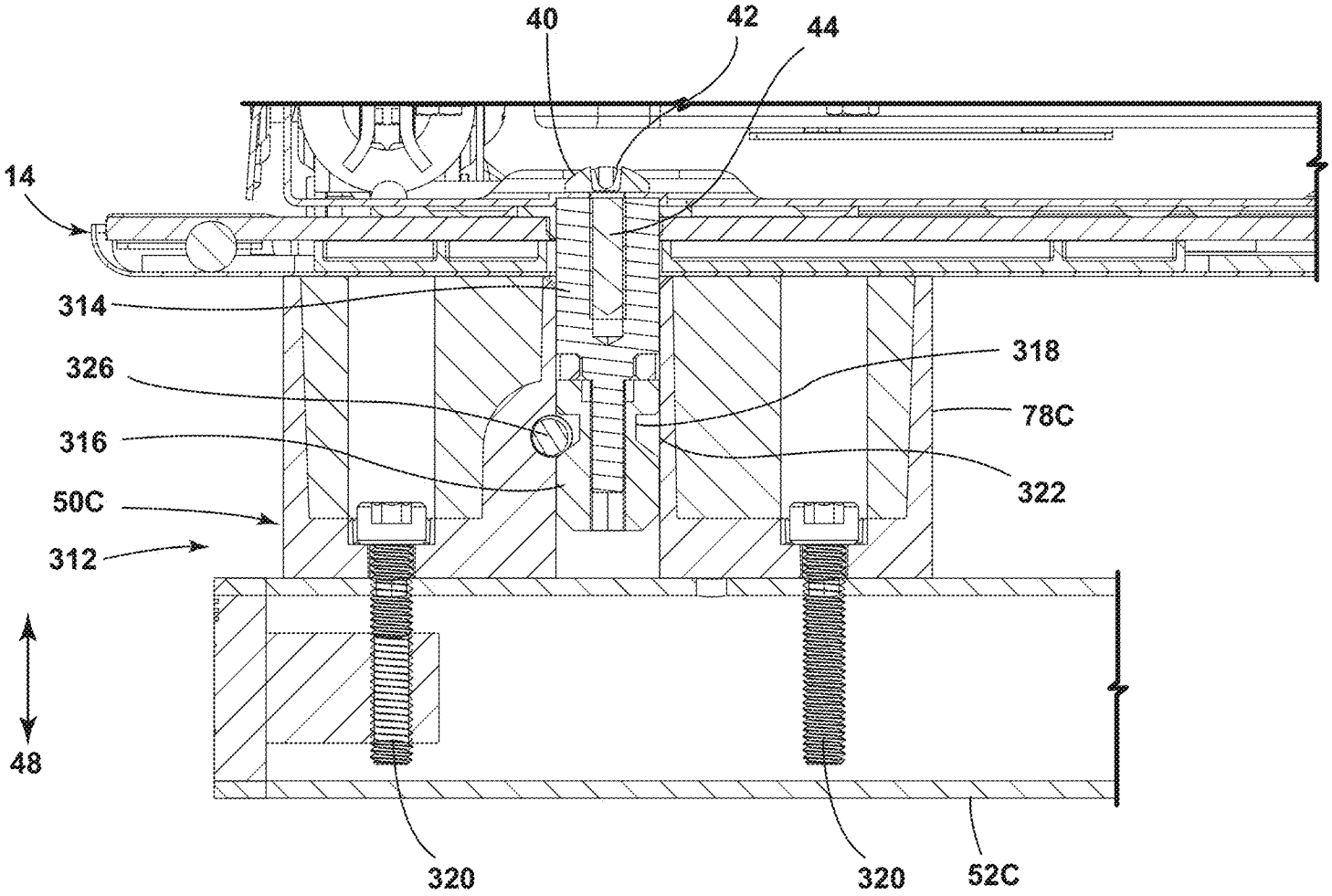
FIG. 43 is an overhead view of a cross-section taken through line XLIII-XLIII of FIG. 42.
Figure 44:
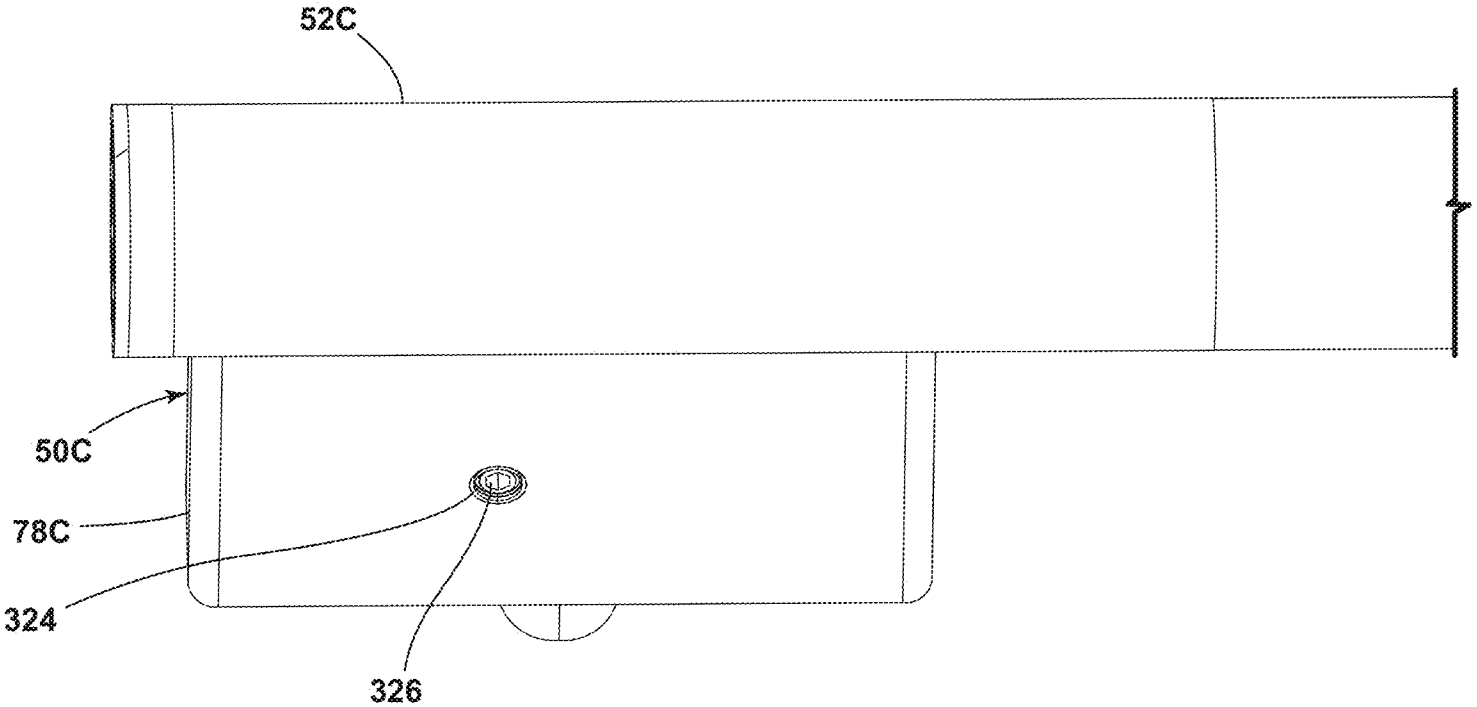
FIG. 44 is a perspective view of the handle assembly of FIG. 42.

Referring now to FIGS. 42-44, another handle assembly 50C is herein described that can be selectively attached and detached from the mounting stud 40 of the door 14 of the oven 10. The handle assembly 50C can be manipulated to, from, and between an attached state 312 (see, e.g., FIG. 43) attached to the door 14 and a detachable state (not separately illustrated) separable from the door 14. The door 14 includes a first bushing 314 attached to the mounting stud 40 of the door 14. The first bushing 314 extends outside of the interior 34 of the door 14. The door 14 further includes a second bushing 316 attached to the first bushing 314 such as through the use of cooperating threads. Degree of separation of the second bushing 316 from the external surface 30 of the door 14 can be adjusted by tightening or loosening the second bushing 316 relative to the first bushing 314. The second bushing 316 has a radial recess 318. The handle assembly 50C includes a handle 52C and a standoff 78C. A pair of fasteners 320 fasten the handle 52C and the standoff 78C together. The standoff 78C is disposed between the handle 52C and the door 14.

The standoff 78C further includes a bushing receiver 322. In the attached state 312, the second bushing 316 and a portion of the first bushing 314 are disposed within the bushing receiver 322. The standoff 78C further includes an aperture 324 that is open to the external environment 22 and a grub screw 326 sized to be screwed into and out of the aperture 324. The aperture 324 is positioned so that the grub screw 326, when inserted into the aperture 324, is disposed within the radial recess 318 of the second bushing 316. The grub screw 326 thus attaches the handle assembly 50C to the second bushing 316, and thus the door 14, and places the handle assembly 50C in the attached state 312. To manipulate the handle assembly 50C to the detachable state, the user can remove the grub screw 326. The user can then pull the handle assembly 50C away from the door 14 and the first bushing 314 and the second bushing 316 remain attached to the door 14 and withdraw from the bushing receiver 322 of the standoff 78C. The user can then replace the handle 52C. The user can reverse the above process to reattach the handle assembly 50C. In an alternative, the first bushing 314 and the second bushing 316 could be combined into a single bushing with the radial recess 318 and the bushing still receiving the mounting stud 40.

The door 14 for each of the handle assemblies 50-50C discussed above can be the same without having to recite the features of the door 14 for every one of the handle assemblies 50-50C. In addition, the door 14 can include two identical handle assemblies 50-50C to attach the respective handle 52-52C to the door 14. The discussion above can be thought of as the left side handle assembly 50-50C dividing the oven 10 into two approximately equal halves. The oven 10 can then further include a right side handle assembly sharing the same handle as the left hand handle assembly 50-50C. In such instances, the right side handle assembly can be a mirror image of the left side handle assembly 50-50C or identical to the left side handle assembly 50-50C but sharing the handle in common.

All of the handle assemblies 50-50C address the problem described above, because the user can cause the handle assembly 50-50C to move from the attached state 54, 230, 306, 312 to the detachable state 56, 232, 308, from the external environment 22. While in the detachable state 56, 232, 308, the user can then separate the handle assembly 50-50C from the door 14 and replace the handle 52-52C. The user does not need to remove the door 14 from the cabinet 12 of the oven 10 in order to remove the handle assembly 50-50C. The process of changing the handle 52-52C is thus much easier for the user to perform. Further, by tightening or loosening the bushings 64, 242, 314/316 onto the mounting stud 40, the user can make the standoff 78-78C of the handle assembly 50-50C flush with the external surface 30 of the door 14. In other words, the bushings 64, 242, 314/316 can be adjusted so that there is no unreasonably large gap between the standoff 78-78C and the external surface 30 of the door 14. A further benefit is that the handle assemblies 50-50C can be manipulated to their respective detachable states 56, 232, 308 without the use of a tool. In the instances of the handle assemblies 50-50C, a screwdriver is likely to be the only tool required. In the instance of the handle assembly 50B with the snap-fit piece 246, reattaching the handle assembly 50B to the door 14 to take the attached state 306 would not require a tool either. The handle assemblies 50-50C allow for handles 52-52C to be sold separately in a variety of colors and finishes to accommodate the user's aesthetic desire.

Although discussed in the context of an oven 10, the handle assemblies 50-50C can be utilized with any appliance that incorporates a door with a handle, such as a refrigerator, a dishwasher, an oven, a microwave oven, and so on.

According to a first aspect of the present disclosure, an oven comprises: (a) a door comprising (i) an external surface that faces an external environment and (ii) a mounting stud that projects from an interior of the door toward the external environment; and (b) a handle assembly comprising a handle, an attached state where the handle assembly is attached to the door through coupling with the mounting stud, a detachable state where the handle can be removed from the handle assembly, and a push-button mechanism that, when manipulated, transitions the handle assembly from the attached state to the detachable state.

According to a second aspect of the present disclosure, the oven of the first aspect further comprises a bushing comprising: (a) a door end that extends into an aperture into the door, (b) a handle end that projects away from the external surface of the door, (c) a body portion between the door end and the hand end, (d) a recess adjacent to a flange between the flange and the handle end, and (e) a receiving cavity open at the door end into which the mounting stud projects in a fastening manner to fasten the bushing to the door, and wherein (i) in the attached state, the handle assembly is coupled to the bushing, and (ii) in the detachable state, the handle assembly can be decoupled from the bushing.

According to a third aspect of the present disclosure, the oven of the first aspect is presented, wherein the handle assembly further comprises a standoff disposed between the handle and the external surface of the door, the standoff housing the push-button mechanism and comprising: (a) a top surface facing upwards when the door is in a closed position, (b) a bottom surface facing downwards when the door is in the closed position, (c) a door edge facing the external surface of the door, (d) a handle edge facing the handle, (e) a pair of apertures disposed elevationally between the top surface and the bottom surface through which a pair of fasteners extend to fasten the standoff and the handle together, and (f) a bushing receiver disposed elevationally between the top surface and the bottom surface, the bushing receiver disposed so that the bushing receiver receives a bushing attached to the mounting stud of the door when the handle is in the attached state but can release from the bushing while the handle is pulled away from the door when the handle assembly is in the detachable state.

According to a fourth aspect of the present disclosure, the first aspect is presented, wherein (a) the handle assembly further comprises a standoff disposed between the handle and the external surface of the door, the standoff housing the push-button mechanism, (b) the push-button mechanism comprises a pair of compression springs and a push-button body, (c) the push-button body comprises (i) a relaxed position where the push-button mechanism is not being manipulated by a force external to the oven, (ii) a pushed position where the first push-button mechanism is being manipulated, (iii) a button wall comprising a top edge facing upward when the door is in a closed position, a bottom edge facing downward when the door is in the closed position, a rear edge facing the external surface of the door, a forward edge facing the handle, an outside surface facing the external environment, and an inside surface facing away from the outside surface, (iv) a pair of projections extending from the inside surface of the button wall away from the outside surface of the button wall, the pair of compression springs being disposed around the pair of projections and cooperating with the standoff to bias the push-button body to the relaxed position, (v) another projection extending from the inside surface of the button wall away from the outside surface of the button wall, the other projection cooperating with the standoff to limit the extent to which the push-button body can be pushed into the standoff as the push-button mechanism is manipulated, (vi) a locking wall extending from the inside surface of the button wall away from the outside surface of the button wall, the locking wall comprising a locking aperture with an unlocking portion and a locking portion disposed further away from the inside surface of the button wall than the unlocking portion, (d) the locking portion of the locking aperture of the locking wall cooperates with a bushing of the oven attached to the mounting stud to secure the handle assembly to the door of the oven in the attached state when the push-button mechanism is not manipulated, and (e) as the push-button body is manipulated to the pushed position and the handle assembly takes the detachable state, the unlocking portion of the locking aperture of the locking wall does not cooperate with the bushing and the locking aperture extends around the bushing but is separated from the bushing, allowing the handle assembly to be detached from the bushing and thus the door of the oven.

According to a fifth aspect of the present disclosure, the oven of the first aspect is presented, wherein (i) the handle assembly further comprises a standoff disposed between the handle and the external surface of the door, (ii) the handle comprises a hollow cylinder with a cavity disposed therein and a pair of apertures through the hollow cylinder, and (iii) a pair of fasteners extend through the pair of apertures to fasten the standoff and the handle together.

According to a sixth aspect of the present disclosure, the oven of the first aspect further comprises a bushing fastened to the mounting stud, the bushing partially extending through an aperture of the door into the door and partially extending away from the external surface of the door, the bushing comprising (a) a body portion, (b) a flange projecting radially outward from the body portion, and (c) a recess into the body portion adjacent to the flange, wherein (i) the push-button mechanism comprises a push-button body with a locking wall and a locking aperture through the locking wall, the body portion of the bushing extending through the locking aperture, (ii) the push-button body comprises a relaxed position, and in the relaxed position, the locking wall at least partially resides within the recess of the bushing with the flange of the bushing disposed between the locking wall and the external surface of the door, thus placing the handle assembly in the attached state, and (iii) the push-button body further comprises a pushed position, and in the pushed position, the locking wall and the bushing do not interact, thus placing the handle assembly in the detachable state.

According to a seventh aspect of the present disclosure, the oven of the sixth aspect is presented, wherein (i) the handle assembly further comprises a standoff disposed between the handle and the external surface of the door, the standoff housing the first push-button mechanism, and (ii) the push-button mechanism further comprises compression springs that cooperate with the standoff to bias the push-button body to the relaxed position.

According to an eighth aspect of the present disclosure, an oven comprises: (a) a door comprising (i) an external surface that faces an external environment and (ii) a mounting stud that projects toward the external environment from an interior of the door; and (b) a handle assembly comprising a handle, an attached state where the handle assembly is attached to the door through coupling with the mounting stud, a detachable state where the handle assembly can be removed from the door, and a push-button mechanism manipulable from an end of the handle that, when manipulated, transitions the handle assembly from the attached state to the detachable state.

According to a ninth aspect of the present disclosure, the oven of the eighth aspect further comprises an anchor cylinder coupling the handle assembly to the mounting stud, the anchor cylinder comprising (i) a door end having an aperture that receives the mounting stud to couple the handle assembly to the door, (ii) a handle end that terminates within an interior chamber of the handle, and (iii) a body that extends between the door end and the handle end, with the body projecting through an anchor aperture of the handle to enter the interior chamber of the handle.

According to a tenth aspect of the present disclosure, the oven of the eighth aspect is presented, wherein (a) the handle assembly further comprises a standoff disposed between the handle and the external surface of the door, the standoff comprising: (i) a top surface facing upwards when the door is in a closed position, (ii) a bottom surface facing downwards when the door is in the closed position, (iii) a door edge facing the external surface of the door, (iv) a handle edge facing the handle, (v) a pair of apertures disposed between the top surface and the bottom surface through which a pair of fasteners extend to fasten the standoff and the handle together, each of pair of apertures having a larger diameter section open at the door edge where a head of the fastener is disposed, and (vi) an anchor aperture disposed between the top surface and the bottom surface and laterally between the pair of apertures, the anchor aperture open at the door edge and extending through the standoff to open at the handle edge, and (b) the anchor aperture extends through the anchor aperture and into an interior chamber of the handle to couple the handle assembly to the mounting stud.

According to an eleventh aspect of the present disclosure, the oven of any one of the eighth through tenth aspects is presented, wherein (i) the handle comprises an interior chamber disposed at the end of the handle and opening into the interior chamber disposed at the end of the handle, and (ii) the push-button mechanism is disposed within the interior chamber of the handle and manipulable at the opening of the handle.

According to an twelfth aspect of the present disclosure, the oven of the eleventh aspect is presented, wherein (a) the push-button mechanism comprises a compression spring and a push-button body, the push-button body comprises (i) a relaxed position where the push-button body is not being manipulated by a force from the external environment, (ii) a pushed position where the push-button body is being manipulated further into an internal chamber of the handle, (iii) a button accessible at the opening of the handle and sized and positioned to be flush with the opening when the push-button body is in the relaxed position, (iv) a hollow semi-cylinder extending inward into the internal chamber of the handle from the button, the hollow semi-cylinder including a planar wall facing the door, a semi-cylindrical wall contiguous with the planar wall, and an internal chamber bound by the planar wall and the semi-cylindrical wall, and (v) an anchor aperture through the planar wall, the anchor aperture including a locking section and an unlocking section that is larger than the locking section, and (b) the compression spring energizes when the push-button body is manipulated to the pushed position to bias the push-button body back to the relaxed position.

According to a thirteenth aspect of the present disclosure, the oven of the twelfth aspect further comprises: an anchor cylinder comprising (i) a door end with an aperture into which the mounting stud extends to fasten the anchor cylinder to the mounting stud, (ii) a handle end that terminates within the interior chamber of the push-button body, (iii) a body that extends between the door end and the handle end, with the body projecting through an anchor aperture of the handle to enter the interior chamber of the handle and the anchor aperture of the push-button body to enter the interior chamber of the push-button body, and (iv) a radial groove disposed near the handle end and positioned to interact with the planar wall of the push-button body at the anchor aperture, wherein, the handle end of the anchor cylinder disposed within the interior chamber of the push-button body has a diameter that is larger than a width of the locking section of the anchor aperture of the push-button body but smaller than a width of the unlocking section of the anchor aperture.

According to a fourteenth aspect of the present disclosure, the oven of the thirteenth aspect is presented, wherein (i) in the relaxed position of the push-button body, the radial groove of the anchor cylinder extends through the locking section of the anchor aperture of the push-button body, and the planar wall of the push-button body is disposed between the handle end of the anchor cylinder and the external surface of the door, thus securing the handle assembly in the attached state, and (ii) in the pushed position of push-button body, the radial groove of the anchor cylinder extends through the unlocking section of the anchor aperture of the push-button body, and the planar wall of the push-button body and the anchor cylinder do not interact, thus placing the handle assembly in the detachable state.

According to a fifteenth aspect of the present disclosure, an oven comprises: (a) a door comprising (i) an external surface that faces an external environment and (ii) a mounting stud that projects from an interior of the door toward the external environment; and (b) a handle assembly comprising a handle, an attached state where the handle assembly is attached to the door through coupling with the mounting stud, a detachable state where the handle can be removed from the handle assembly, and a snap-fit feature accessible to manipulate at the handle assembly that, when manipulated, transitions the handle assembly from the attached state to the detachable state.

According to a sixteenth aspect of the present disclosure, the oven of the fifteenth aspect further comprises a bushing comprising: (a) a body comprising (i) a door end with an aperture to receive and fasten to the mounting stud, (ii) a handle end with an aperture to receive a bushing fastener, the aperture extending toward the door end while the aperture of the door end extends toward the handle end, (iii) a recess into the body disposed between the door end and the handle end, and (iv) a pair of spaced apart fingers extends from the handle end and away from the external surface of the door, (b) a snap-fit piece attached to the body, the snap-fit piece comprising (i) an O-shaped section disposed against the handle end of the body, the O-shaped section having a central aperture aligned with the aperture of the handle end to receive the bushing fastener, (ii) a flexural element extending from the O-shaped section between the pair of spaced apart fingers of the body and then substantially orthogonally relative to the O-shaped section to terminate within or adjacent to the recess, the flexural element terminating in (iii) a retaining feature that cooperates with a retaining aperture of the handle assembly to secure the handle assembly to the mounting stud in the attached state but, when manipulated further into the recess, does not cooperate with the handle assembly and transitions the handle assembly to the detachable state, and (c) a bushing fastener extending through the central aperture of the O-shaped section of the snap-fit piece and into the aperture in the handle end of the body of the bushing to fasten the snap-fit piece to the body.

According to a seventeenth aspect of the present disclosure, the oven of the fifteenth aspect further comprises a bushing attached to the mounting stud, the bushing comprising a retaining feature; wherein the handle assembly further comprises: (a) a standoff disposed between the external surface of the door and the handle, the standoff comprises: (i) a top surface facing upwards when the door is in a closed position, (ii) a bottom surface facing downwards when the door is in the closed position, (iii) a door edge facing the door, (iv) a handle edge facing the handle, (v) a bushing receiver disposed between the top surface and the bottom surface, the bushing receiver open at the door edge and receiving the bushing, (vi) a pair of fastener apertures disposed between the top surface and the bottom surface, the pair of fastener apertures being open at the handle edge, and (vii) an aperture into bushing receiver that is accessible from the external environment, the aperture cooperating with the retaining feature of the bushing to couple the handle assembly to the bushing and thus place the handle assembly in the attached state, and when the retaining feature is manipulated from the external environment through the aperture, the handle assembly is separable from the bushing and thus takes the detachable state; and (b) a pair of fasteners extending through the pair of fastener receivers of the standoff and into the handle to attach the handle to the standoff.

According to an eighteenth aspect of the present disclosure, the oven of the fifteenth aspect is presented, wherein (i) the handle comprises a hollow cylinder, a first end, a second end, and a pair of apertures through the hollow cylinder near the first end, and (ii) the handle assembly further comprises a pair of fasteners that extend through the pair of apertures of the handle to fasten the handle to a standoff of the handle assembly.

According to a nineteenth aspect of the present disclosure, the oven of the fifteenth aspect further comprises: a bushing attached to the mounting stud, the bushing comprising a recess, a retaining feature disposed within or adjacent to the recess, the retaining feature attached to a flexural element, wherein (i) the handle assembly further comprises a standoff to which the handle is attached, the standoff comprising a bushing receiver within which the bushing is disposed, a retaining feature that cooperates with the retaining feature of the bushing to couple the handle assembly to the bushing and place the handle assembly in the attached state, and an aperture adjacent the retaining feature that is accessible from an external environment, and (ii) manipulating the retaining feature from the external environment through the aperture causes the flexural element of the bushing to flex and the retaining feature to decouple from the aperture of the handle assembly to place the handle assembly in the detachable state.

According to a twentieth aspect of the present disclosure, the oven of the nineteenth aspect is presented, wherein the aperture from where the retaining feature of the bushing can be manipulated is disposed at a bottom surface of the standoff.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven comprising:

a door comprising (i) an external surface that faces an external environment and (ii) a mounting stud that projects from an interior of the door toward the external environment;

a handle assembly comprising a handle, an attached state where the handle assembly is attached to the door through coupling with the mounting stud, a detachable state where the handle assembly can be removed from the door, and a push-button mechanism that, when manipulated, transitions the handle assembly from the attached state to the detachable state; and a bushing comprising:

a door end that extends into an aperture into the door, a handle end that projects away from the external surface of the door toward the handle when the handle is in the attached state, a body portion between the door end and the handle end, a recess adjacent to a flange between the flange and the handle end, and a receiving cavity open at the door end into which the mounting stud projects in a fastening manner to fasten the bushing to the door, wherein, in the attached state, the handle assembly is coupled to the bushing, and wherein, in the detachable state, the handle assembly can be decoupled from the bushing.

2. The oven of claim 1, wherein the handle assembly further comprises a standoff disposed between the handle and the external surface of the door, the standoff housing the push-button mechanism, and the push-button mechanism comprises a pair of compression springs and a push-button body, the push-button body comprises:

a relaxed position where the push-button mechanism is not being manipulated by a force external to the oven;

a pushed position where the push-button mechanism is being manipulated;

a button wall comprising a top edge facing upward when the door is in a closed position, a bottom edge facing downward when the door is in the closed position, a rear edge facing the external surface of the door, a forward edge facing the handle, an outside surface facing the external environment, and an inside surface facing away from the outside surface, a pair of projections extending from the inside surface of the button wall away from the outside surface of the button wall, the pair of compression springs being disposed around the pair of projections and cooperating with the standoff to bias the push-button body to the relaxed position, another projection extending from the inside surface of the button wall away from the outside surface of the button wall, the other projection cooperating with the standoff to limit the extent to which the push-button body can be pushed into the standoff as the push-button mechanism is manipulated, a locking wall extending from the inside surface of the button wall away from the outside surface of the button wall, the locking wall comprising a locking aperture with an unlocking portion and a locking portion disposed further away from the inside surface of the button wall than the unlocking portion, the locking portion of the locking aperture of the locking wall cooperates with the bushing of the oven attached to the mounting stud to secure the handle assembly to the door of the oven in the attached state when the push-button mechanism is not manipulated, and as the push-button body is manipulated to the pushed position and the handle assembly takes the detachable state, the unlocking portion of the locking aperture of the locking wall does not cooperate with the bushing and the locking aperture extends around the bushing separated from the bushing, allowing the handle assembly to be detached from the bushing and thus the door of the oven.

3. The oven of claim 1, wherein the handle assembly further comprises a standoff disposed between the handle and the external surface of the door, the handle comprises a hollow cylinder with a cavity disposed therein and a pair of apertures through the hollow cylinder; and a pair of fasteners extend through the pair of apertures to fasten the standoff and the handle together.

4. The oven of claim 1 further comprising:

a cabinet defining a cooking chamber and an opening into the cooking chamber, wherein, the door is coupled to the cabinet and is manipulable between (i) a closed position where access to the cooking chamber from the external environment is denied and (ii) an open position where access to the cooking chamber from the external environment is allowed.

5. The oven of claim 1, wherein the flange of the bushing projects radially outward from the body portion, and the recess of the bushing is recessed radially inward into the body portion.

6. The oven of claim 1, wherein the door further comprises (i) structural components that form the interior of the door and (ii) a component providing the external surface facing the external environment, the aperture of the door is open within the interior and at the component providing the external surface, and the mounting stud of the door comprises (i) a head within the interior of the door, the head having a diameter that is larger than the aperture of the door, (ii) a shank extending from the head forward through the aperture of the door toward the external environment, and (iii) a threaded end extending from the shank, the threaded end projecting into the receiving cavity of the bushing in the fastening manner to fasten the bushing to the door.

7. The oven of claim 1, wherein the handle assembly further comprises a standoff housing the push-button mechanism, the standoff disposed between the handle of the handle assembly and the external surface of the door, the standoff comprising:

a top surface that faces upward when the door is in a closed position, a bottom surface that faces downward when the door is in the closed position, a door edge that faces the external surface of the door, a lateral side, a handle edge that faces the handle of the handle assembly when the handle assembly is in the attached state, and a bushing receiver disposed (i) elevationally between the top surface and the bottom surface when the door is in the closed position and (ii) between the door edge and the handle edge, with the bushing receiver open at the door edge, the handle end of the bushing is disposed within the bushing receiver of the standoff when the handle is in the attached state, and the bushing receiver of the standoff releases from the handle end of the bushing when the handle assembly transitions from the detachable state to a detached state.

8. The oven of claim 7, wherein the handle of the handle assembly comprises (i) a hollow cylinder that defines a cavity, (ii) a first end, (iii) a second end, and (iv) a pair of apertures through the hollow cylinder disposed closer to the first end than the second end, the standoff further comprises a pair of apertures disposed elevationally between the top surface and the bottom surface when the door is in the closed position, the pair of apertures of the standoff in alignment with the pair of apertures of the handle, and the handle assembly further comprises a pair of fasteners extending through the pair of apertures of the standoff and the pair of apertures of the handle to fasten the standoff and the handle together.

9. The oven of claim 8, wherein the push-button mechanism comprises (a) a pair of compression springs and (b) a push-button body disposed between the top surface and the bottom surface of the standoff, the push-button body comprising a button wall disposed at the lateral side of the standoff, the button wall comprising (i) a top edge that faces upwards when the door is in the closed position, (ii) a bottom edge that faces downwards when the door is in the closed position, (iii) a rear edge aligned with the door edge of the standoff, the rear edge facing the external surface of the door when the handle is in the attached state, (iv) a forward edge disposed near the handle edge of the standoff, the forward edge facing the handle, (v) an outside surface that faces the external environment, (vi) an inside surface that faces away from the outside surface, (vii) a pair of projections extending from the inside surface away from the outside surface, the pair of compression springs disposed around the pair of projections, and (viii) another projection extending from the inside surface away from the outside surface, and a locking wall extending from the inside surface of the button wall substantially orthogonally away from the outside surface of the button wall and laterally near the door edge of the standoff, the locking wall comprising a locking aperture therethrough, the locking aperture aligned with the bushing receiver of the standoff and comprising an unlocking portion and a locking portion, the locking portion disposed further away from the inside surface of the button wall than the unlocking portion and narrower than the unlocking portion.

10. The oven of claim 9, wherein when the handle assembly is in the attached state, (i) the body portion of the bushing extends through the locking aperture of the push-button body and into the bushing receiver of the standoff and (ii) the door end of the bushing resides within the bushing receiver of the standoff.

11. The oven of claim 10, wherein the push-button body is manipulable to, from, and between a relaxed position and a pushed position, the standoff further comprises a spring barrier wall opposing the inside surface of the button wall of the push-button body of the push-button mechanism, with the pair of compression springs disposed between the spring barrier wall and the inside surface of the button wall, and in the relaxed position, the push-button body is not subjected to a force external to the oven that would otherwise move the push-button body to the pushed position and the pair of compression springs bias the push-button body to the relaxed position.

12. The oven of claim 11, wherein when the push-button body is in the relaxed position and the handle assembly is in the attached state, the bushing extends through the locking aperture of the locking wall, and the locking portion of the locking aperture at least partially resides within the recess of the bushing with the flange of the bushing disposed between the locking wall and the external surface of the door.

13. The oven of claim 12, wherein when the push-button body is in the relaxed position and the handle assembly is in the attached state, the body portion of the bushing adjacent to the recess in the forward direction towards the handle end opposes the locking wall adjacent to the locking portion of the locking aperture, so as to resist a force pulling the handle assembly away from the door to maintain the handle in the attached state.

14. The oven of claim 13, wherein a force moving the push-button body to the pushed position pushes the locking portion of the locking aperture away from residing within the recess of the bushing, thus placing the handle assembly in the detachable state.

15. The oven of claim 14, wherein with the push-button body in the pushed position and the handle assembly in the detachable state, the bushing still extends through the locking aperture with the unlocking portion of the locking aperture disposed around the bushing and clear of the bushing.

16. The oven of claim 15, wherein with the push-button body in the pushed position and the handle assembly in the detachable state, the pair of projections holding the compression springs extend through a slot through the spring barrier wall of the standoff and the compression springs are energized.

17. The oven of claim 16, wherein after the force manipulating the push-button body toward the pushed position ends, the pair of compression springs push the push-button body back to the relaxed position.

18. An oven comprising:

a door comprising (i) an external surface that faces an external environment and (ii) a mounting stud that projects from an interior of the door toward the external environment; and a handle assembly comprising a handle, an attached state where the handle assembly is attached to the door through coupling with the mounting stud, a detachable state where the handle assembly can be removed from the door, a push-button mechanism that, when manipulated, transitions the handle assembly from the attached state to the detachable state, and a standoff disposed between the handle and the external surface of the door, the standoff housing the push-button mechanism and comprising:

a top surface facing upwards when the door is in a closed position, a bottom surface facing downwards when the door is in the closed position, a door edge facing the external surface of the door, a handle edge facing the handle, a pair of apertures disposed elevationally between the top surface and the bottom surface through which a pair of fasteners extend to fasten the standoff and the handle together, and a bushing receiver disposed elevationally between the top surface and the bottom surface, the bushing receiver disposed so that the bushing receiver receives a bushing attached to the mounting stud of the door when the handle is in the attached state but can release from the bushing while the handle is pulled away from the door when the handle assembly is in the detachable state.

19. An oven comprising:

a door comprising (i) an external surface that faces an external environment and (ii) a mounting stud that projects from an interior of the door toward the external environment;

a handle assembly comprising a handle, an attached state where the handle assembly is attached to the door through coupling with the mounting stud, a detachable state where the handle assembly can be removed from the door, and a push-button mechanism that, when manipulated, transitions the handle assembly from the attached state to the detachable state; and a bushing fastened to the mounting stud, the bushing partially extending through an aperture of the door into the door and partially extending away from the external surface of the door, the bushing comprising (i) a body portion, (ii) a flange projecting radially outward from the body portion, and (iii) a recess into the body portion adjacent to the flange, wherein, the push-button mechanism comprises a push-button body with a locking wall and a locking aperture through the locking wall, the body portion of the bushing extending through the locking aperture, wherein, the push-button body comprises a relaxed position, and in the relaxed position, the locking wall at least partially resides within the recess of the bushing with the flange of the bushing disposed between the locking wall and the external surface of the door, thus placing the handle assembly in the attached state, and wherein, the push-button body further comprises a pushed position, and in the pushed position, the locking wall and the bushing do not interact, thus placing the handle assembly in the detachable state.

20. The oven of claim 19, wherein the handle assembly further comprises a standoff disposed between the handle and the external surface of the door, the standoff housing the push-button mechanism, and the push-button mechanism further comprises compression springs that cooperate with the standoff to bias the push-button body to the relaxed position.

* * * * *